US008888481B2

(12) United States Patent
O'Neill et al.

(10) Patent No.: US 8,888,481 B2
(45) Date of Patent: Nov. 18, 2014

(54) MACHINE FOR MANUFACTURING CONCRETE U-WALL TYPE CONSTRUCTION BLOCKS BY MOLDING EACH CONCRETE U-WALL CONSTRUCTION BLOCK FROM CONCRETE POURED ABOUT A BLOCK CAGE MADE FROM REINFORCING MATERIAL WHILE SAID BLOCK CAGE IS LOADED WITHIN SAID MACHINE

(75) Inventors: Raymond O'Neill, Spring Lake Heights, NJ (US); Dennis Carr, Atkinson, NH (US)

(73) Assignees: Stable Concrete Structures, Inc., Oxford, AL (US); Concrete Systems, Inc., Hudson, NH (US)

( * ) Notice: Subject to any disclaimer, the term of this patent is extended or adjusted under 35 U.S.C. 154(b) by 367 days.

(21) Appl. No.: 12/987,218

(22) Filed: Jan. 10, 2011

(65) Prior Publication Data

US 2012/0175814 A1 Jul. 12, 2012

(51) Int. Cl.

| | |
|---|---|
| ***B28B 7/04*** | (2006.01) |
| ***B28B 7/30*** | (2006.01) |
| ***B28B 13/04*** | (2006.01) |
| ***B28B 7/00*** | (2006.01) |

(52) U.S. Cl.

CPC ..... *B28B 13/04* (2013.01); *B28B 7/0044* (2013.01); *B28B 7/0029* (2013.01)

USPC .... 425/438; 425/441; 425/442; 425/436 RM; 425/460; 425/468; 249/63; 249/155; 249/162; 249/163; 249/169; 249/172; 249/177; 249/186

(58) Field of Classification Search

CPC ..... B28B 7/0058; B28B 7/0061; B28B 7/04; B28B 7/10; B28B 7/16; B28B 7/285; B28B 7/36; B28B 15/00

USPC ..... 249/155, 158, 159, 160, 162, 163, 165, 249/166, 168–172, 177, 186, 189, 63; 425/436, 438, 441–443, 436 RM, 447, 425/452, 460, 468–470

See application file for complete search history.

(56) References Cited

U.S. PATENT DOCUMENTS

| | | | | |
|---|---|---|---|---|
| 848,697 A * | 4/1907 | Silva et al. | ..... | 249/125 |
| 877,874 A * | 1/1908 | Tsanoff | ..... | 249/125 |

(Continued)

FOREIGN PATENT DOCUMENTS

| | | | | |
|---|---|---|---|---|
| GB | 560222 * | 3/1944 | ..... | B28B 7/30 |
| GB | 1446398 A * | 8/1976 | ..... | B28B 7/30 |

(Continued)

*Primary Examiner* — Dimple Bodawala

(74) *Attorney, Agent, or Firm* — Thomas J. Perkowski, Esq., P.C.

(57) ABSTRACT

A machine for and method of manufacturing concrete U-wall construction blocks, each having a front wall portion and a pair of stem portions extending from said front wall portion. The method involves providing a system of molding jacket panels, including a core molding assembly having a pair of inside stem jacket panels that are adjustably supportable in a substantially parallel manner during a molding process, and arranged is such a manner that the front wall portion is molded in downwardly facing direction toward a horizontal support surface and completely enclosed in one or more molding jacket panels. Before block molding operations, the thickness of the front wall portion of the U-wall construction block is set by determining the thickness of a front wall surface liner and installing the front wall surface forming liner within the system of molding jacket panels. Also, thickness of the stem portions of the U-wall construction block is set by determining the proper distance between the pair of said inside stem jacket panels supported in a parallel manner during the block molding process. Thereafter, concrete is poured or injected through pour openings provided in the molding jacket apparatus to form the front wall portion and stem portions of the concrete U-wall block.

17 Claims, 26 Drawing Sheets

(56) References Cited

U.S. PATENT DOCUMENTS

| | | | | | |
|---|---|---|---|---|---|
| 1,380,598 | A | | 6/1921 | Schenk | |
| 1,471,951 | A | | 10/1923 | Evans | |
| 1,569,057 | A | | 1/1926 | White et al. | |
| 1,569,257 | A | * | 1/1926 | Boes | 425/412 |
| 1,572,305 | A | | 2/1926 | Nelson | |
| 1,584,920 | A | * | 5/1926 | Flint et al. | 249/172 |
| 1,695,327 | A | | 12/1928 | Goldston | |
| 2,193,847 | A | | 3/1940 | Strong | |
| 2,271,066 | A | | 1/1942 | Ehrenhaft | |
| 2,334,804 | A | | 11/1943 | Atterbury | |
| 2,395,216 | A | | 2/1946 | Fitzpatrick | |
| 2,523,349 | A | | 2/1950 | Wissinger | |
| 2,531,576 | A | | 11/1950 | McClellan et al. | |
| 2,582,161 | A | * | 1/1952 | Randall | 425/424 |
| 2,624,928 | A | | 1/1953 | Long | |
| 2,648,889 | A | | 8/1953 | Youtz | |
| 2,874,442 | A | | 2/1959 | Henderson | |
| 3,277,556 | A | | 10/1966 | Platt et al. | |
| 3,694,128 | A | * | 9/1972 | Foxen | 425/412 |
| 3,694,531 | A | | 9/1972 | Glass | B28B 21/18 |
| 4,219,513 | A | | 8/1980 | Miller | E01G 4/00 |
| 4,272,050 | A | | 6/1981 | del Valle | E04B 1/348 |
| 4,289,293 | A | * | 9/1981 | Cashion | 249/74 |
| 4,594,206 | A | | 6/1986 | Grafton | E02B 3/14 |
| 4,606,878 | A | | 8/1986 | Day et al. | B28B 1/30 |
| 4,673,159 | A | | 6/1987 | Schmidgall | B28B 7/30 |
| 4,684,294 | A | | 8/1987 | O'Neill | E02D 5/00 |
| 4,953,280 | A | | 9/1990 | Kitzmiller | B23P 17/00 |
| 5,163,261 | A | | 11/1992 | O'Neill | E02D 29/02 |
| 5,205,943 | A | | 4/1993 | Jazzar | B28B 7/22 |
| 5,620,280 | A | | 4/1997 | Melby et al. | E02B 3/04 |
| 6,827,570 | B2 | * | 12/2004 | Sumrall et al. | 425/219 |
| 6,923,565 | B2 | | 8/2005 | Johnson | B28C 5/00 |
| 7,048,250 | B2 | | 5/2006 | Mothes | B28B 7/16 |
| 7,553,109 | B2 | * | 6/2009 | Blundell | 405/286 |
| 8,317,502 | B1 | * | 11/2012 | Grey | 425/63 |
| 2008/0174041 | A1 | | 7/2008 | Firedman et al. | B28B 1/08 |
| 2009/0173872 | A1 | * | 7/2009 | Stott et al. | 249/48 |
| 2012/0139163 | A1 | * | 6/2012 | Garfinkel et al. | 264/336 |
| 2012/0199721 | A1 | * | 8/2012 | Van Lerberg et al. | 249/160 |

FOREIGN PATENT DOCUMENTS

| | | | | | |
|---|---|---|---|---|---|
| JP | 06099420 | A | * | 4/1994 | B28B 7/18 |
| JP | 11286003 | A | * | 10/1999 | B28B 7/00 |

* cited by examiner

MACHINE FOR MANUFACTURING CONCRETE U-WALL TYPE CONSTRUCTION BLOCKS BY MOLDING EACH CONCRETE U-WALL CONSTRUCTION BLOCK FROM CONCRETE POURED ABOUT A BLOCK CAGE MADE FROM REINFORCING MATERIAL WHILE SAID BLOCK CAGE IS LOADED WITHIN SAID MACHINE

BACKGROUND OF THE INVENTION

1. Field of the Invention

The present invention relates to an improved method of and machine for manufacturing U-wall type construction elements for building soil retaining walls and the like, and a method of operating the same with improved levels of efficiency.

2. Brief Description of Related Art

Retaining walls are widely used in a variety of architectural and site development applications including, for example, office developments, commercial complexes, industrial sites, residential developments, waterfront and coastal structures, and highway cut and fill areas. In such applications, it is not uncommon for the height of retaining walls to exceed 20 feet or more. In nearly all applications, such retaining walls must provide stability against pressures exerted by back fill soil and heavy surcharge loads, and thus be self-supporting.

Self-supporting retaining wall systems are well known.

One popular construction block for self-supporting retaining wall systems is disclosed in U.S. Pat. No. 4,592,678 to McNinch, Jr., et al., which comprises a horizontal cross-section defining a double "T" shape, where the top of the double "T" defines vertical face member and the stem of each "T" defines a generally planar leg member. Notably, elongated tension/reinforcing rods passing through vertically extending holes formed in each leg member are required in order to (i) prevent each stacked block from moving relevant to one another, (ii) achieve vertical alignment of stacked blocks, and (iii) create resistance from overturning moments. While providing a modular construction, such prior art construction blocks and retaining walls, nevertheless suffer from several significant shortcomings and drawbacks.

Another popular construction block for self-supporting retaining wall systems is disclosed in U.S. Pat. No. 5,163,261 to O'Neill, Sr., which comprises a face panel and a plurality of protruding arms. The face panel has a forward wall, a rearward wall, side walls and a top and bottom wall. Such protruding arm extends from the rearward wall of the face panel, and each have an upper wall, lower wall, a back wall and side walls. The upper and lower walls of these protruding arms are each provided with engaging means for facilitating stacking of at least a portion of the protruding arm of one construction element, on top of at least a portion of the protruding arm of another construction element, and preventing relative sliding movement therebetween.

In FIGS. 22 through 24 of U.S. Pat. No. 5,163,261, apparatus is disclosed for molding the U-wall construction elements. As disclosed, the apparatus comprises a face panel mold portion, and a protruding arm mold portion for each protruding arm. The apparatus is typically made from wood or steel panels held together with bolts and nuts, and also includes support means for supporting each protruding arm mold portion substantially vertically upright while the face panel mold portion is cooperatively positioned with respect to the vertically upright protruding arm mold portions. In such a configuration, when concrete or like molding material is poured into the protruding arm mold portions, the concrete fills up the face panel mold portion to a predetermined level. Only after the concrete sets or partially cures in the face panel portion of the block mold, then the protruding arm mold portions can be filled up with concrete.

While the U-wall construction element disclosed in U.S. Pat. No. 5,163,261 has many advantages over the prior art, conventional techniques for manufacturing this U-wall construction block suffer from a number of significant shortcomings and drawbacks.

Conventional methods of U-wall block manufacture require the use of different molds for different sized or dimensioned construction blocks.

Conventional methods of U-wall block manufacture requires a specific sequence of concrete pouring and curing operations during block molding processes, requiring longer times for concrete block manufacture.

Conventional methods of U-wall block manufacture require different molds to provide different textures to the U-wall construction blocks.

Conventional methods of U-wall block manufacture require large amounts of manual labor which is expensive and requires costly human management.

Conventional methods of U-wall block manufacture also creates unnecessary risks to workers required to handle the molds and forms used during prior art constructing procedures.

Thus, there is clearly a great need in the construction art to provide a new and improvement way of and means for manufacturing U-wall construction elements while avoiding the shortcomings and drawbacks of prior art methodologies and apparatus.

OBJECT AND SUMMARY OF THE PRESENT INVENTION

Accordingly, it is a primary object of the present invention to provide an improved method of and a machine for molding U-wall type wall construction blocks and elements, and a method of operating the same in a high-efficiency manner, while avoiding the shortcomings and drawbacks of prior art methodologies.

Another object of the present invention is to provide such an improved method of and machine for manufacturing concrete U-wall construction blocks.

Another object of the present invention is to provide such an improved method of and machine for manufacturing concrete U-wall construction blocks having different front wall thickness (e.g. 6", 8" or 12") and stem section thicknesses that can be achieved by simply adjustments made to the molding machine during setup operations.

Another object of the present invention is to provide such an improved method of and machine for manufacturing concrete U-wall construction blocks in a highly efficient manner using a minimum amount of human labor.

Another object of the present invention is to provide such an improved method of and machine for manufacturing concrete U-wall construction blocks in an automated manner under the control of automation and control subsystem.

Another object of the present invention is to provide such an improved method of and machine for manufacturing concrete U-wall construction blocks which results in lower manufacturing costs, and allows higher quality control during manufacturing operations.

Another object of the present invention is to provide such an improved machine for manufacturing concrete U-wall construction blocks having stem portions with central apertures formed therein that help anchor the construction blocks within the Earth's soil when used to construction retail wall systems.

Another object of the present invention is to provide such an improved method of moving concrete U-wall construction blocks within a factory environment using reinforced steel cages having stem portion with central apertures that are engaged by cylindrical support structures provided in a central molding assembly employed in the block manufacturing machine.

Another object of the present invention is to provide such an improved method of and machine for manufacturing concrete U-wall construction blocks, each having a front wall thickness that is determined by the thickness of a front wall surface forming liner that is installed in the block manufacturing machine prior to the block molding process.

Another object of the present invention is to provide such a block manufacturing machine comprising a system of molding jacket panels including a retractable/protractable core molding assembly providing a pair of inside stem jacket panels that are adjustably supportable in a substantially parallel manner during the molding process.

Another object of the present invention is to provide such a block manufacturing machine, wherein during the block molding process carried out by the machine, the front wall portion is molded facing downwardly toward a horizontal support surface (e.g. ground surface of the factory or plant) and completely enclosed in one or more molding jacket panels specified above.

Another object of the present invention is to provide such a block manufacturing machine, wherein before carrying out the block molding process, the thickness of the front wall portion of the U-wall construction block is set by determining the proper thickness of a front wall surface forming liner, and then installing the front wall surface forming liner within the system of molding jacket panels.

Another object of the present invention is to provide such a block manufacturing machine, wherein thickness of the stem portions of the U-wall construction block is set by determining the proper distance between the pair of inside stem jacket panels supported in a parallel manner by retractable/protractable support mechanism during the block molding process.

Another object of the present invention is to provide such a block manufacturing machine wherein, after determining the thickness of the front wall portion and stem portions of the U-wall construction block, installing a proper thickness front wall surface forming liner in the molding apparatus, and adjusting the distance between the inside stem jacket mold panels, concrete is poured or injected through pour openings in the molding apparatus, to form in various possible ways, the front wall portion and stem portions of the concrete U-wall block, in a high-efficiency manner It is another object of the present invention to provide an improved method of manufacturing a U-wall construction element, which can accommodate a variety of construction specifications and requirements.

Another object of the present invention is to provide a fully-automated robotically-controlled factory for manufacturing concrete U-wall construction blocks using a minimum number of human operators, and resulting in lower manufacturing costs, higher efficiencies, and higher quality control standards, during block manufacturing and inspection operations.

These and other objects of the present invention will become more apparent hereinafter and in the Claims to Invention appended hereto.

BRIEF DESCRIPTION OF THE DRAWINGS

For a further understanding of the Objects of the Present Invention, reference is made to the following detailed Description of the Preferred Embodiments which is to be taken in connection with the accompanying Drawings, wherein.

DETAILED DESCRIPTION OF ILLUSTRATIVE EMBODIMENTS OF THE INVENTION

FIGS. 1A through 1E show an exemplary U-wall type construction element (i.e. block) that can be easily manufactured using the manufacturing machine of the present invention. As shown, the U-wall construction block 1 has a pair of stem portions (i.e. anchor arms) 1A, 1B protruding from the rear of a front wall panel 1C, and a circular aperture 1D formed in each anchor arm of the construction element 1. As illustrated, the face panel 1C which is a prismatic solid having a front wall 1E, a rearward wall 1F, side walls 1G and top and bottom walls 1H and 1I, respectively. As shown, each stem portion (i.e. protruding arm) 1A, 1B is also a prismatic solid, having a back wall 1J, side walls 1K, an upper wall 1L, and a lower wall 1M, as shown. Preferably, the length (i.e. height) of the face panel side walls 1E are equal to the height of the front wall 1J of each protruding arm in order to provide a completely closed-off retaining wall surface when the construction elements are configured together. However, in other embodiments, the height of the face panel can be made lower than the height of the front wall of the protruding arms, to provide various advantages.

As illustrated shown in FIGS. 1A through 1E, the plane of the face panel 1C is disposed substantially orthogonal to both the upper and lower walls 1L and 1M of the protruding arms (i.e. stem portions) 1A, 1B. However, in other embodiments of the present invention, the angle of the face panel with respect to the upper and lower walls of the protruding arms can vary to provide a different facial appearance and surprisingly significant advantages. Thus, depending on the shape and characteristics of any particular retaining wall, the physical dimensions of the construction element can be varied to provide a desired facial appearance.

Figure 1E:
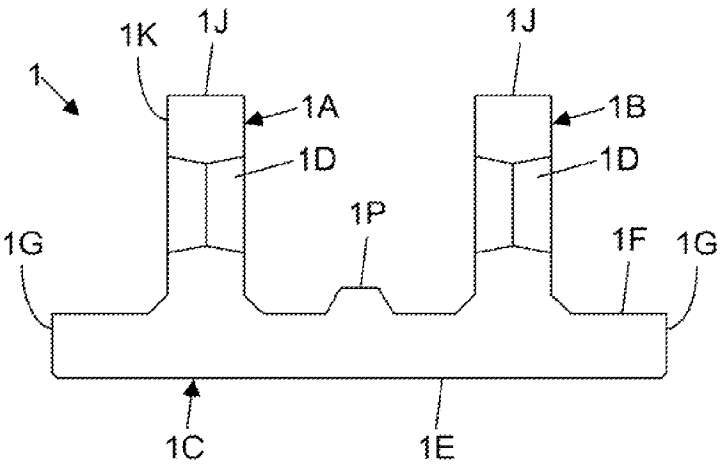
FIG. 1E is a plan cross-sectional view of the U-shaped retaining wall construction element shown in FIG. 1A, showing the circular aperture formed in each anchor arm of the construction element.
Figure 1C:
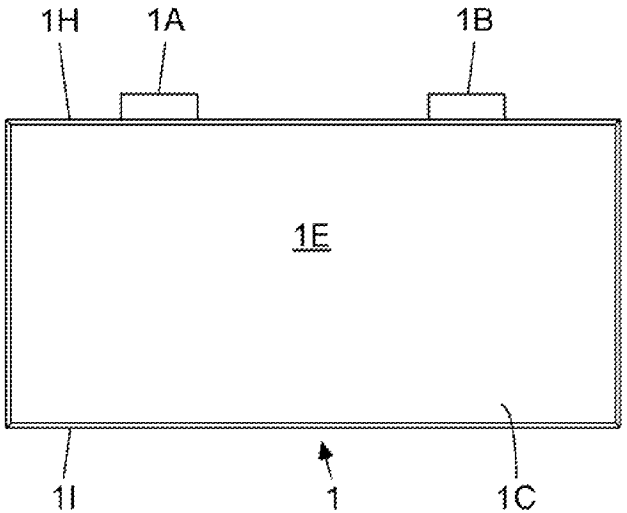
FIG. 1C is a front elevated view of the front wall portion of the U-shaped retaining wall construction element shown in FIG. 1A.
Figure 1D:
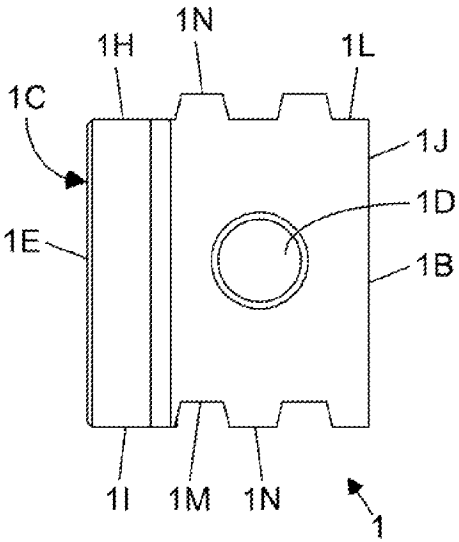
FIG. 1D is an elevated side view of the U-shaped retaining wall construction element shown in FIG. 1A.
Figure 1A:
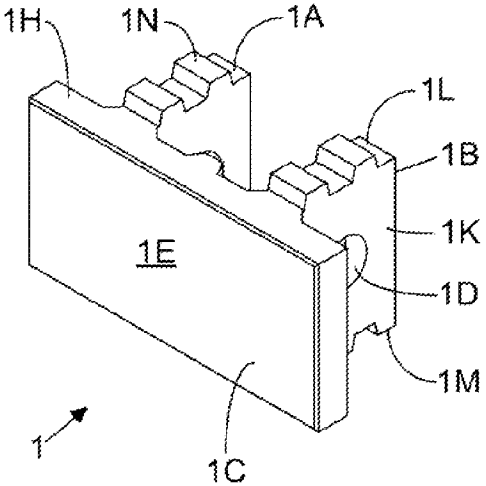
FIG. 1A is a front perspective view of a U-shaped retaining wall construction element ("U-wall construction block") showing it pair of anchor arms protruding from the front wall panel.
Figure 1B:
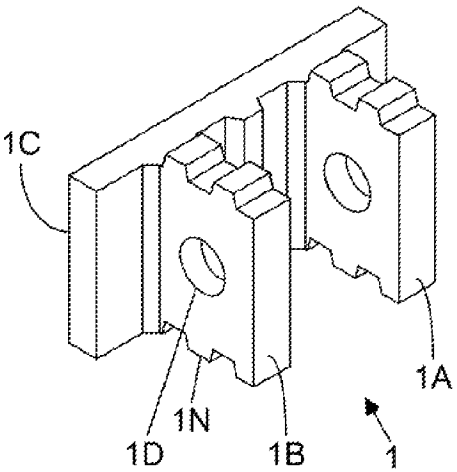
FIG. 1B is a rear perspective view of a U-shaped retaining wall construction element showing it pair of anchor arms protruding from the fear side of the front wall panel.

In addition to the face panel 1C and protruding arms 1A, 1B, the construction element illustrated in FIGS. 1A through 1E further includes a saw-tooth notched pattern 1N formed in the upper and lower walls 1L and 1M, respectively, which facilitate stacking of at least a portion of the protruding arm of one construction element on top of at least a portion of the protruding arm of another construction element, and prevents relative sliding and movement therebetween. As shown in FIG. 1B, these saw-tooth notched patterns comprise alternating (i) projections formed by, for example, projecting planar surfaces, and (ii) indents formed by, for example, non-projecting planar surfaces, with transition sloped surfaces therebetween. These saw-tooth notched patterns 1N facilitate the selective stacking of the construction blocks 1 on top of one another in a variety of different configurations, as will be illustrated hereinafter. U.S. Pat. No. 5,163,261 discloses multiple configurations for the construction block 1.

Figure 2:
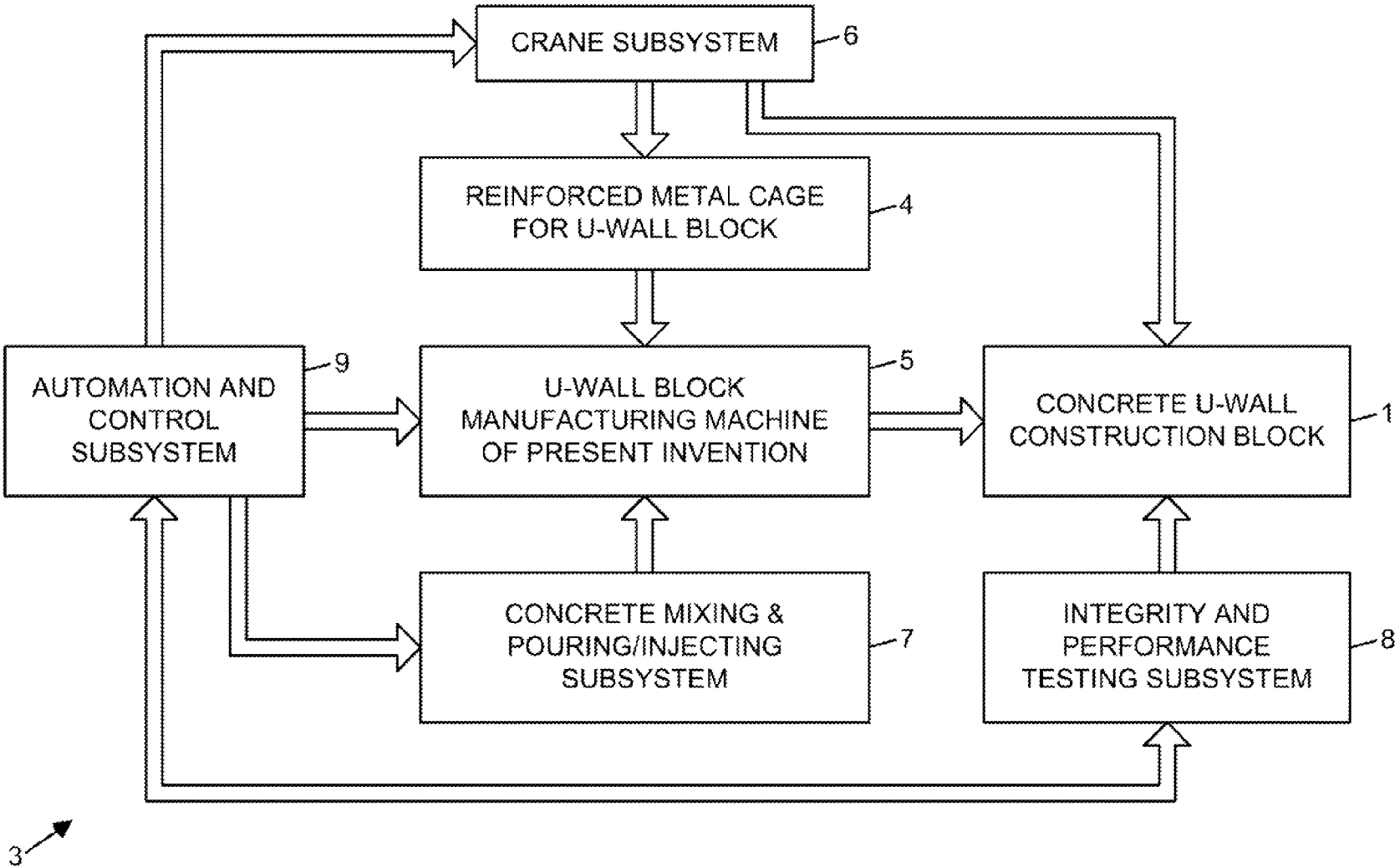
FIG. 2 is a schematic system block diagram showing the components of the automated U-wall construction block manufacturing plant or factory according to the present invention.

FIG. 2 shows the primary components of a U-wall construction block manufacturing plant or factory, according to the present invention. In general, the manufacturing plant or factory 3 comprises a U-wall construction block manufacturing machine 5 as shown in FIGS. 4A through 7U; one or more crane subsystems 6, each having a crane boom and winch mechanism capable of lowering and raising a high-strength cable terminated with a hook that can be releasably attached to the core molding assembly 10 of the machine 5, as described during U-wall block manufacturing operations described in FIGS. 7A through 7U; a concrete mixing and pouring subsystem 7 for mixing concrete and pouring concrete mixtures into the molding machine of the present invention during U-wall block manufacturing operations described in FIGS. 7A through 7U; a testing and inspection subsystem 8 for testing and inspecting the strength and integrity of each concrete U-wall construction block manufactured by the U-wall construction block manufacturing machine 5, at suitable times during the concrete curing process; and an automation and control subsystem 9 operably connected to the a U-wall construction block manufacturing machine 5 shown in FIGS. 4A through 7U, to either fully or partially automate the operation of the U-wall construction block manufacturing machine 5 during U-wall block manufacturing operations described in FIGS. 7A through 7U.

Figure 3A:
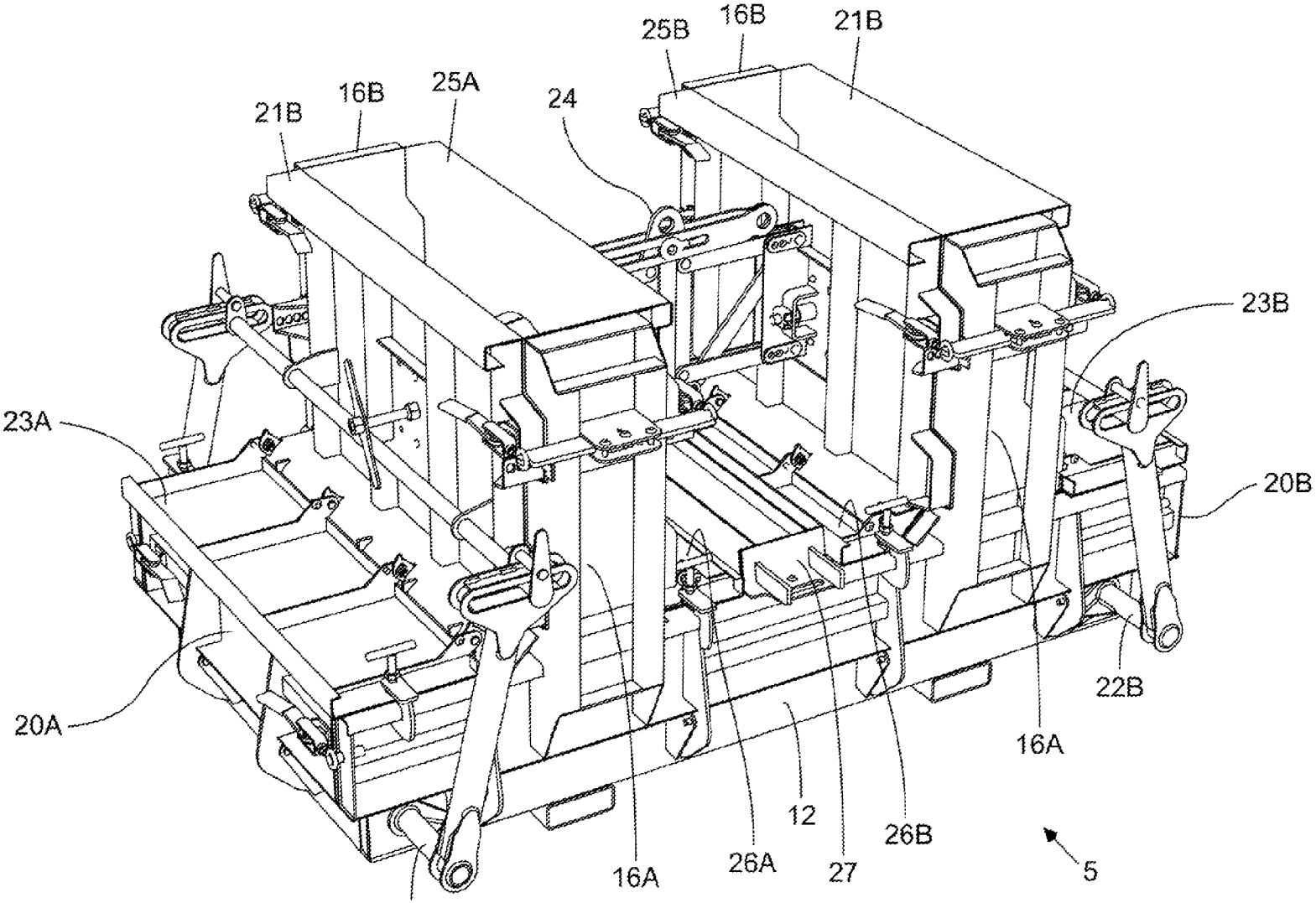
FIG. 3A is a first perspective view of the U-wall construction block molding machine of the present invention, shown arranged in its block molding configuration, but without a block cage (made of reinforcement steel) loaded into the block molding machine.
Figure 3B:
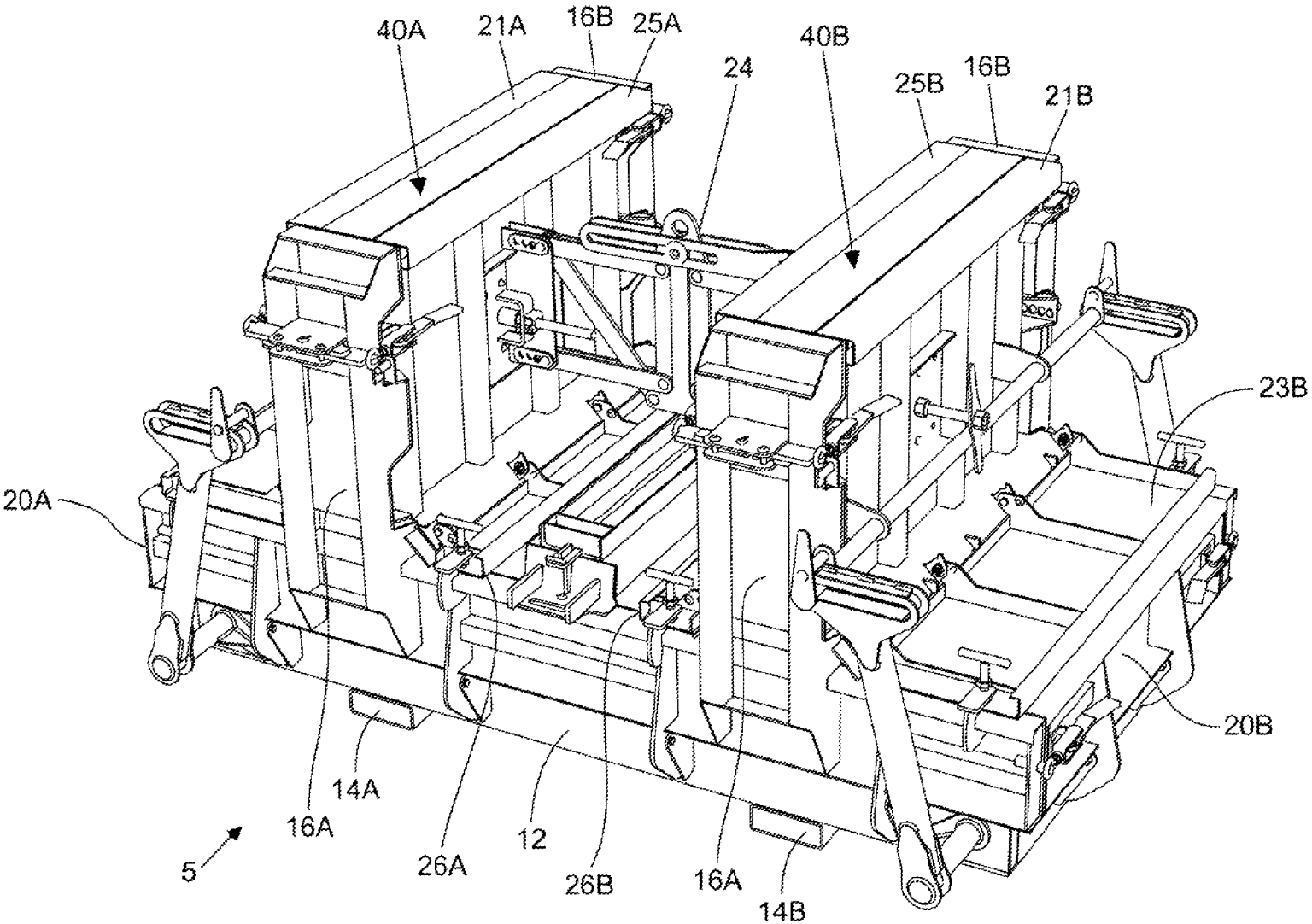
FIG. 3B is a second perspective view of the U-wall construction block molding machine of the present invention, shown arranged in its closed block-molding configuration, but without a block cage (i.e. metal form) loaded into the block molding machine.

FIGS. 3A and 3B shows the U-wall construction block manufacturing machine 5 from several different perspectives. In FIGS. 3A and 3B, block manufacturing machine is shown in an empty state or condition (i.e. there is no molded concrete U-wall block in the machine 5) for purposes of illustration.

In general, the block manufacturing machine of the present invention enables high-efficiency manufacture of retaining wall concrete construction blocks, which in the illustrative embodiment is a U-wall type of construction block, each having a front wall portion and a pair of stem portions extending or projecting from said front wall portion in an orthogonal manner.

In general, the block manufacturing machine 5 comprises: a system of molding jacket panels 12, 16A, 16B, 17A, 17B, 18A, 18B, 20A, 20B, 21A, 21B, 23A, 23B, 25A, 25B, 26A, 26B, and 27 including a retractable/protractable core molding assembly 10 providing a pair of inside stem jacket panels 25A, 25B that are adjustably supportable in a substantially parallel manner during the molding process. During the block molding process carried out by the machine 5 of the present invention, the front wall portion 1C is molded facing downwardly toward a horizontal support surface (e.g. ground surface of the factory or plant) and completely enclosed in one or more molding jacket panels specified above. Before block molding operations, the thickness of the front wall portion 1C of the U-wall construction block 1 is set by determining the proper thickness of a front wall surface forming liner 15, and then installing the front wall surface forming liner 15 within the system of molding jacket panels 12, 18A, 18B, 20A, 20B, 23A, 23B, 26A, 26B, 27. Also, thickness of the stem portions 1A and 1B of the U-wall construction block 1 is set by determining the distance maintained between the pair of inside stem jacket panels 25A and 25B supported in a parallel manner by retractable/protractable support mechanism 24 during the block molding process. Thereafter, concrete is poured or injected into the molding apparatus in various possible ways to mold the U-wall construction block.

Figure 7B:
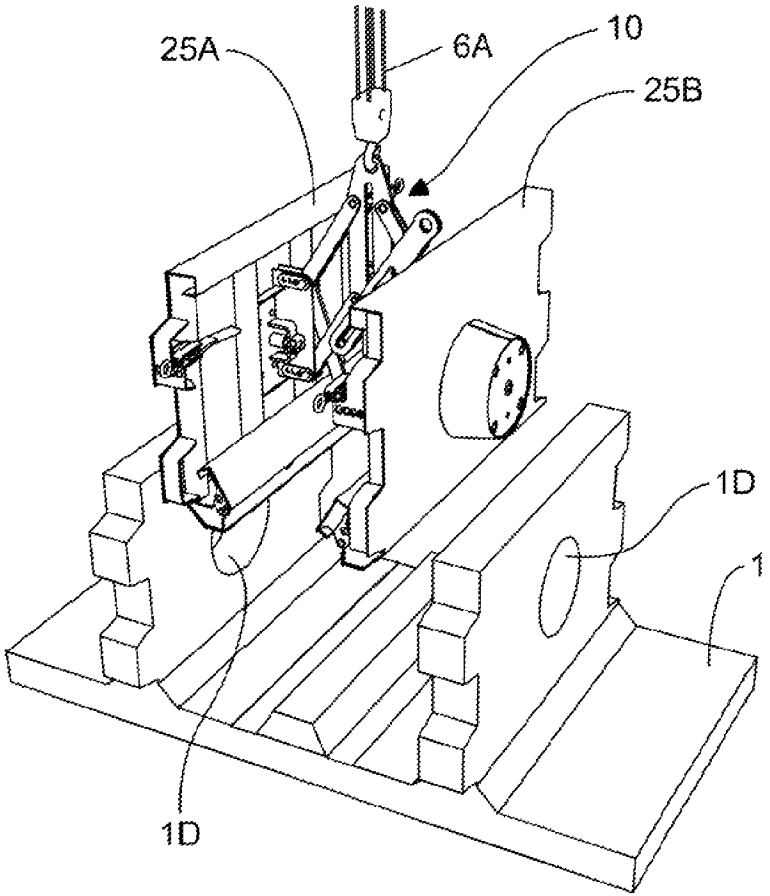
FIG. 7B is a perspective view of the cement U-wall construction block of FIG. 7A showing the core molding assembly of the molding machine being lifted up and away from the U-wall construction block, revealing clearly its inner stem jacket covers, each having a hinged inner pour cover connected thereto, and a support hub for engaging within a matched aperture formed in the molded cement U-wall construction block.
Figure 7A:
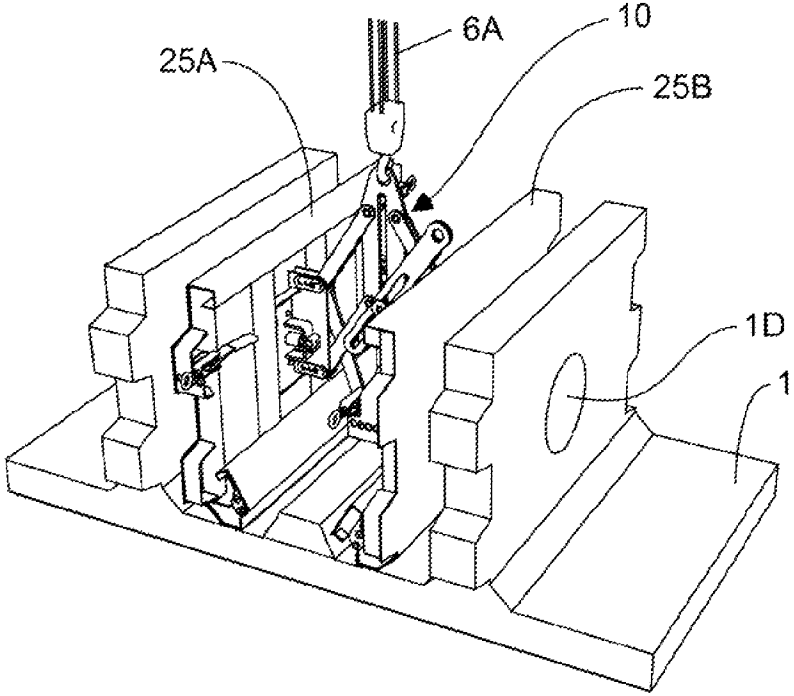
FIG. 7A is a perspective view of a cement U-wall construction block that has been manufactured using the U-wall construction block molding machine of the present invention, and showing its core molding assembly thereof being disengaged from the molded U-wall construction block, while arranged in its refracted configuration.
Figure 7D:
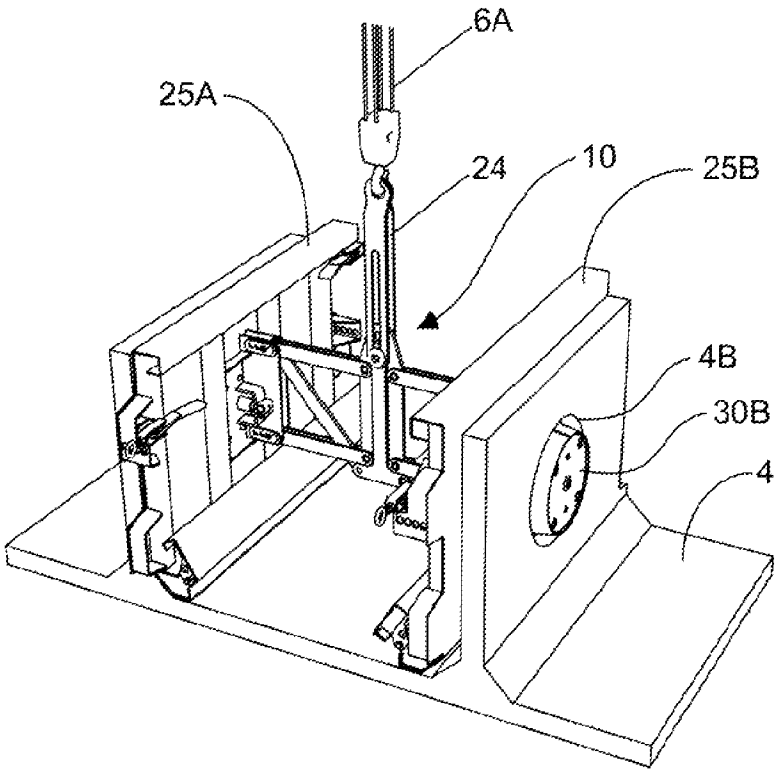
FIG. 7D is a perspective view of the core molding assembly showing its support cylinders engaged with the central apertures formed in the stems sections of the steel reinforcement cage, for the U-wall construction block to be manufactured using the U-wall construction block molding machine of the present invention.
Figure 7C:
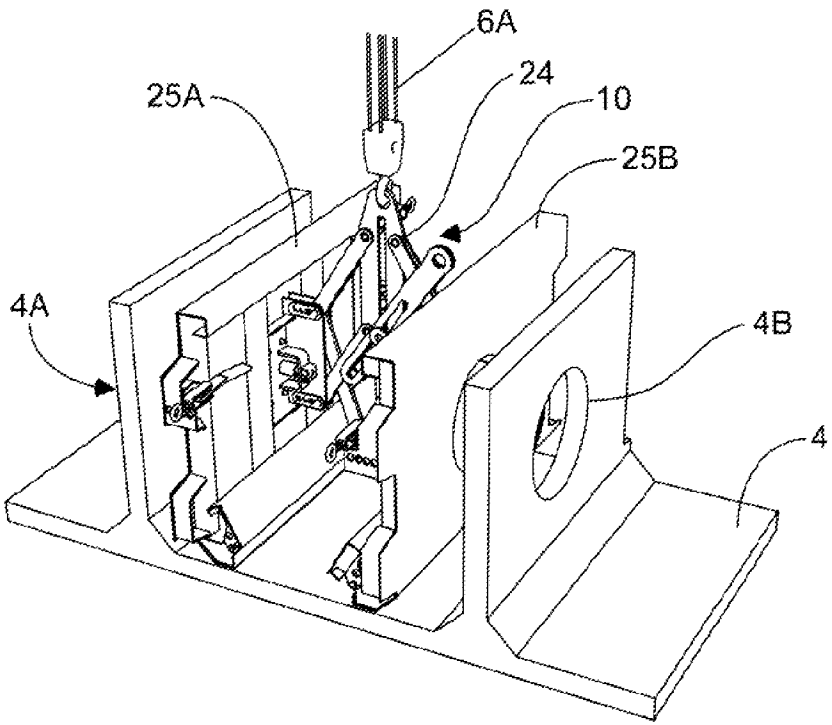
FIG. 7C is a perspective view of the core molding assembly of the molding machine shown being lowered between the stem sections of the steel reinforcement cage designed for the U-wall construction wall block to be manufactured using the U-wall construction block molding machine of the present invention.
Figure 7E:
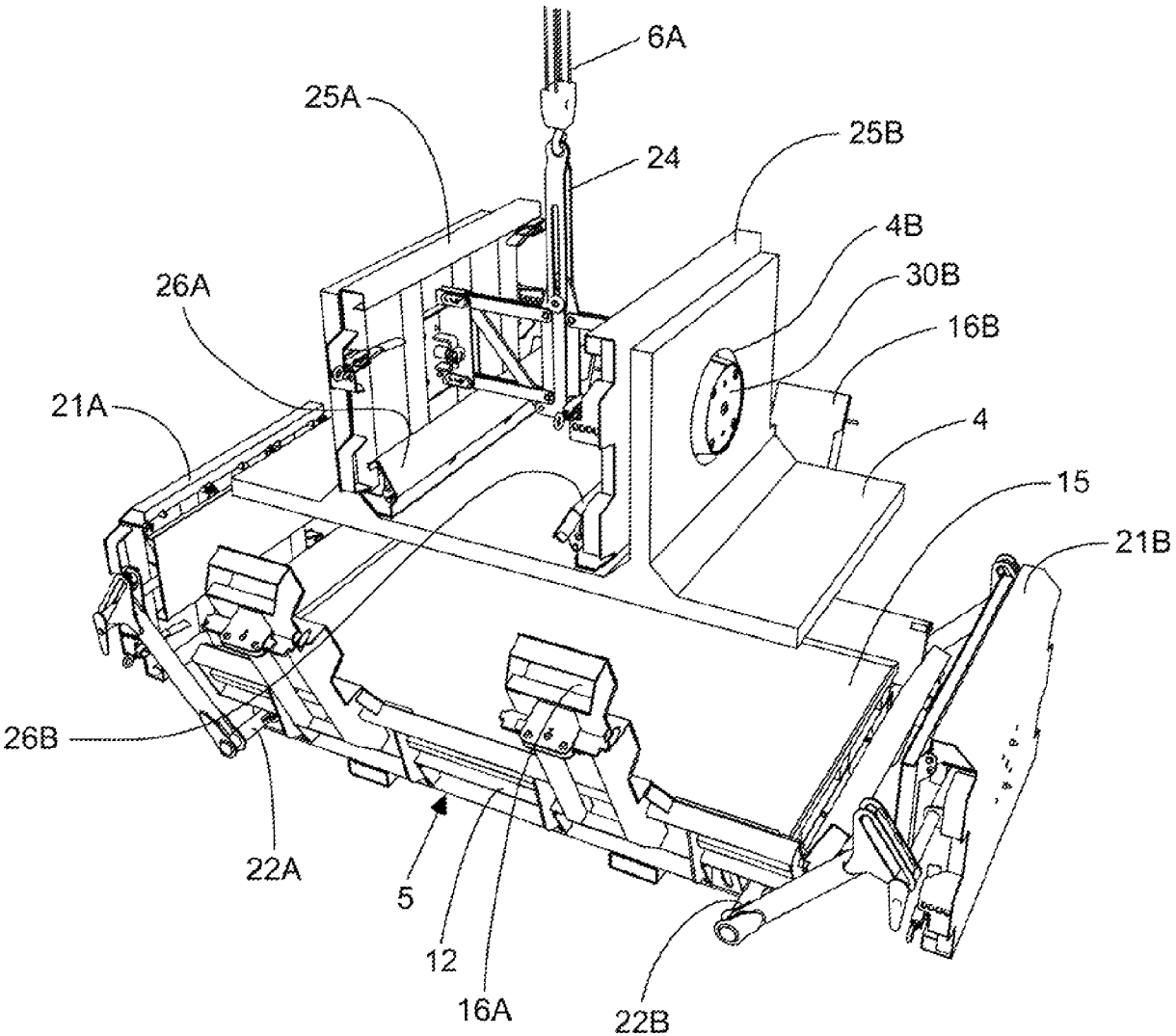
FIG. 7E is a perspective view of the core molding assembly and steel reinforcement cage for a U-wall construction block, shown suspended by a crane and being installed within the U-wall construction block molding machine of the present invention, while arranged in its protracted cage-loading configuration.
Figure 7G:
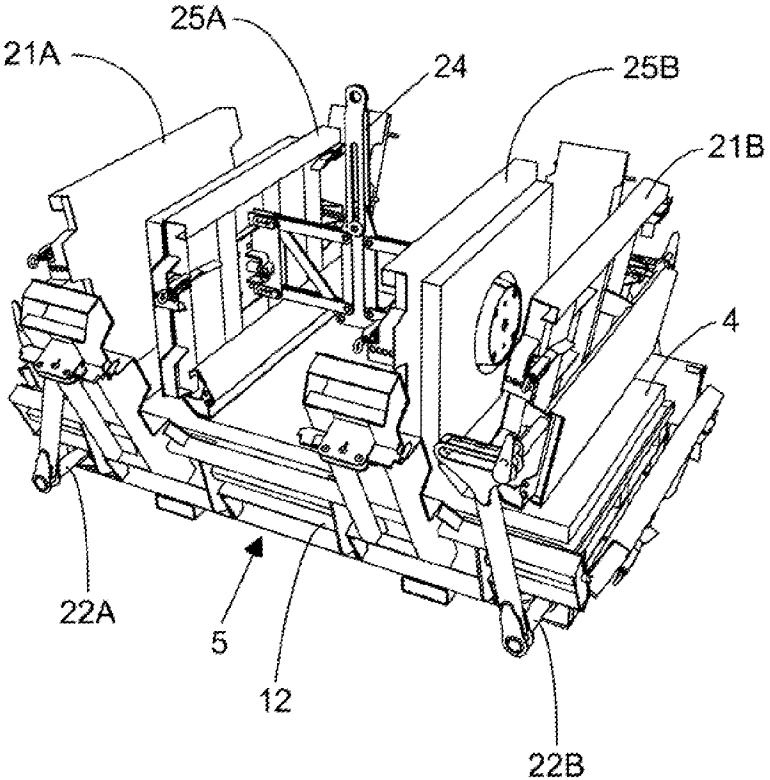
FIG. 7G is a perspective view of the U-wall construction block molding machine of the present invention, showing the core molding assembly loaded on the front panel forming liner installed in the machine, with the inner pour covers rotated upwardly, and the hinged outer stem jacket panels rotated upwardly and towards the outer surface of the metal cage, and aligned together.
Figure 7F:
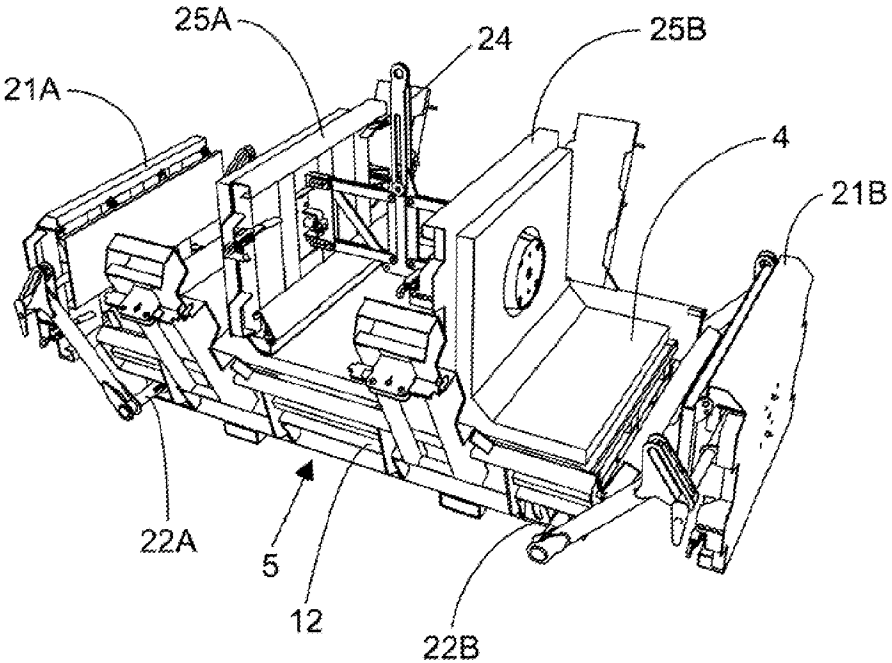
FIG. 7F is a perspective view of the core molding assembly and steel reinforcement cage, shown loaded/positioned onto the front face panel forming liner that has been installed in the block molding machine of the present invention, while the core molding assembly is its arranged in its protracted cage-loading configuration.
Figure 7I:
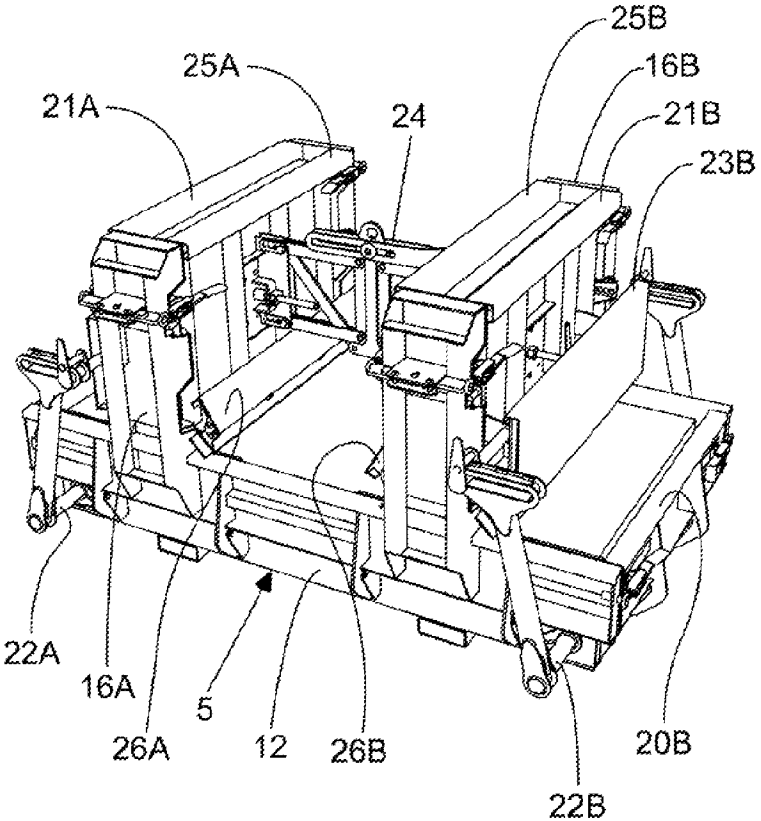
FIG. 7I is a perspective view of the U-wall construction block molding machine of the present invention, showing the core molding assembly and metal cage loaded in the machine, the end rails rotated upwardly and closed, and the side stem jacket panels and rails rotated upwardly and closed.

For example, one method of molding involves opening jacket pour covers 23A, 23B, 26A, 26B as shown in FIG. 7I, and pouring or injecting concrete into the molding apparatus to form the front wall portion 1C during the block molding process. Thereafter, without waiting for time to lapse for the poured concrete to cure, the jacket pour covers 23A, 23B, 26A, 26B can be closed and locked, and then concrete poured or injected into the pour openings 40A and 40B shown in FIGS. 7K and 7L, to form the stem portions 1A and 1B of the concrete U-wall block.

Figure 7H:
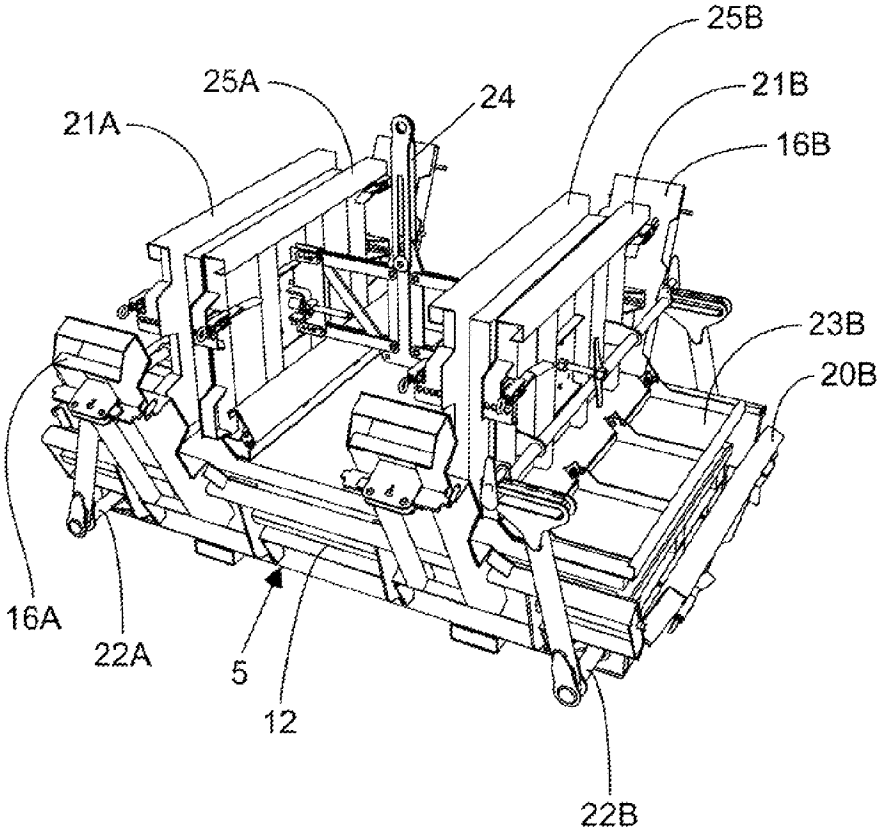
FIG. 7H is a perspective view of the U-wall construction block molding machine of the present invention, showing the core molding assembly and metal cage loaded in the machine, and the hinged outer stem jacket doors/panels aligned so that the stem wall screws can be installed therethrough.
Figure 7K:
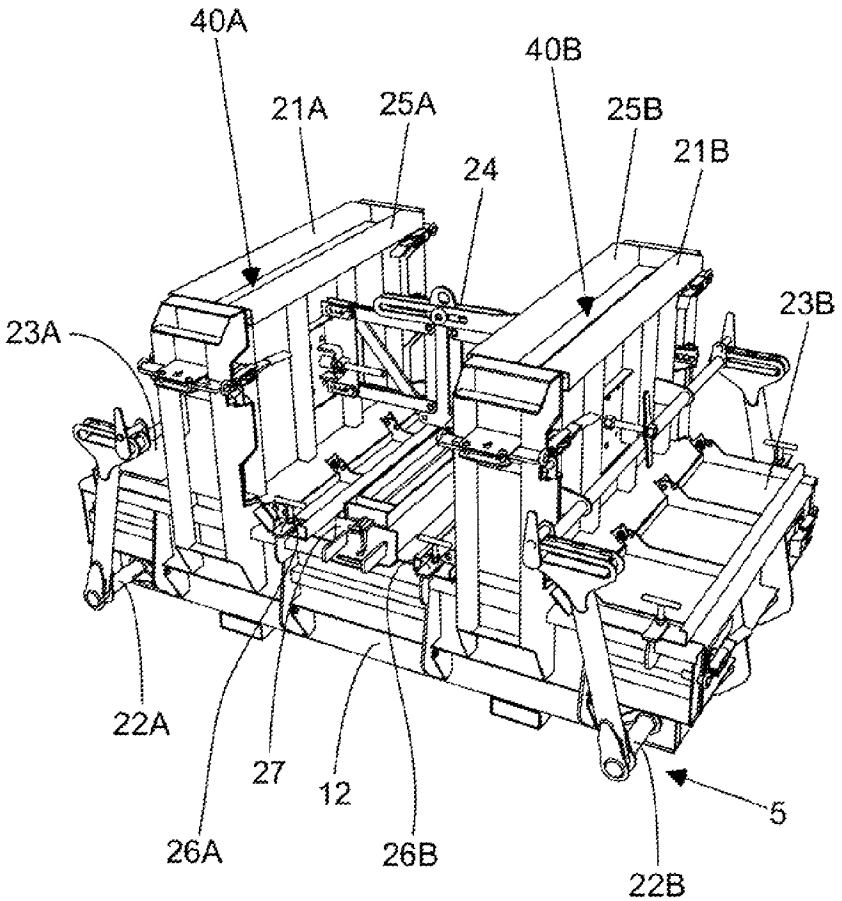
FIG. 7K is a perspective view of the U-wall construction block molding machine of the present invention, showing the core molding assembly and metal cage loaded in the machine, the inner stem jacket and outer stem jacket pour covers closed, and the mold assembly ready to pour concrete into the stems sections of the construction block being molded about the metal cage.
Figure 7J:
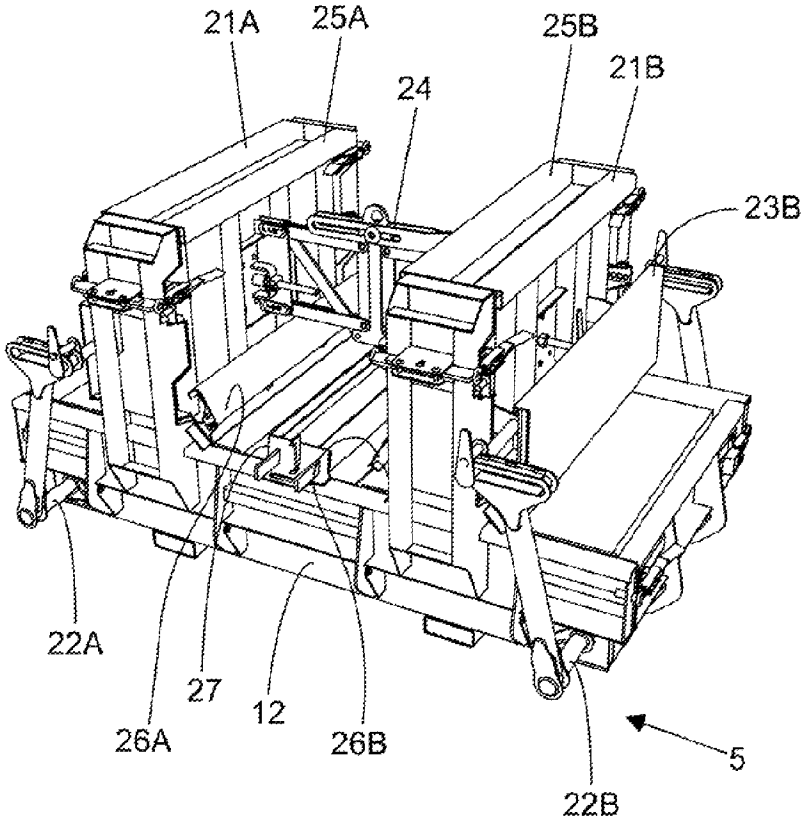
FIG. 7J is a perspective view of the U-wall construction block molding machine of the present invention, showing the core molding assembly and metal cage loaded in the machine, and center cover panel (i.e. plain or beam style) installed.
Figure 7L:
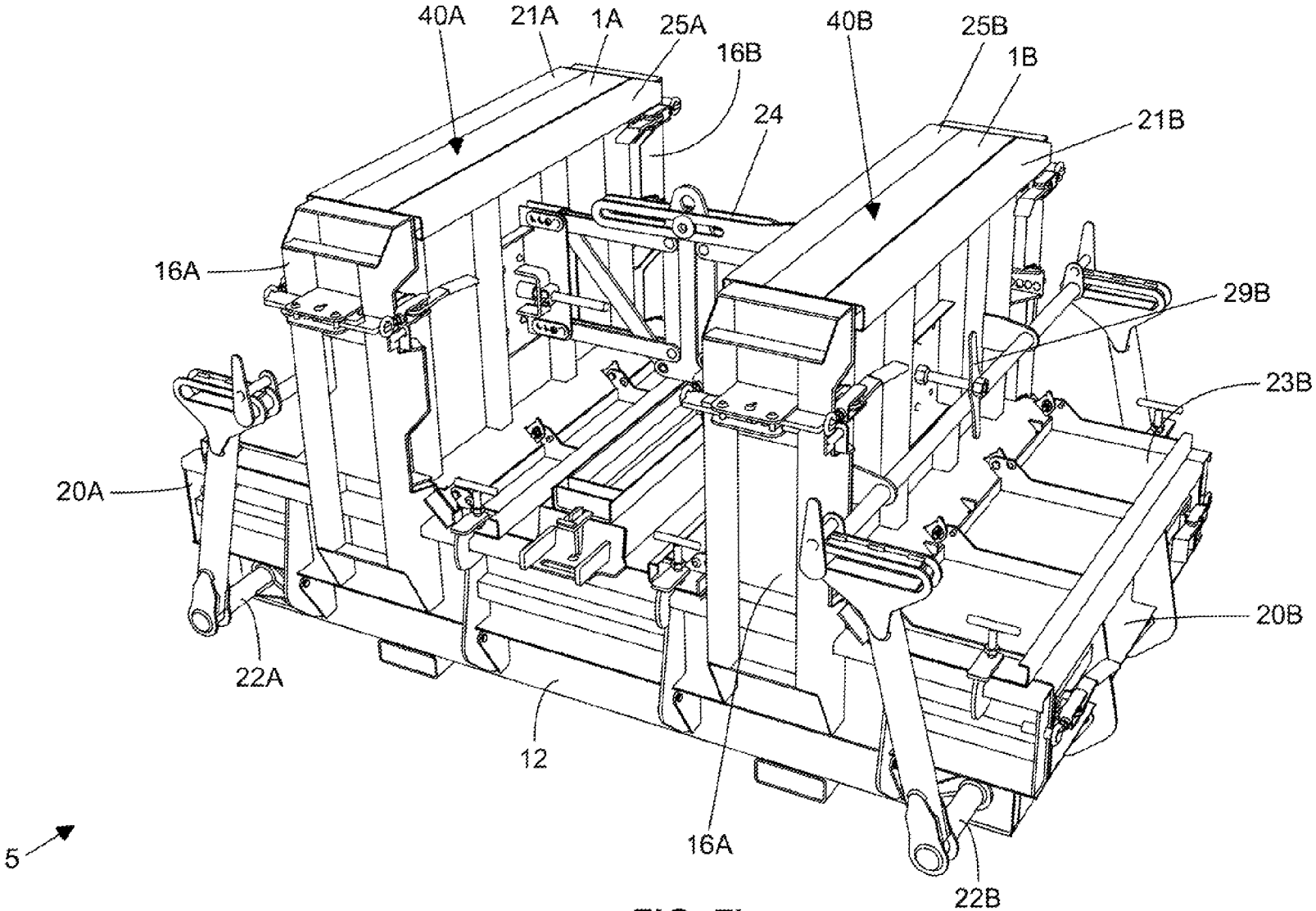
FIG. 7L is a perspective view of the U-wall construction block molding machine of the present invention, showing both the face section and stem sections of the U-wall construction block filled (i.e. poured) with concrete after the concrete pouring process completed, and the concrete allowed to cure for a sufficient time period.

Another method of molding involves closing and locking jacket pour covers 23A, 23B, 26A, 26B as shown in FIGS. 7K and 7L, and then pouring or injecting concrete into through pour openings 40A and 40B, to form the front wall portion 1C and then the stem portions 1A and 1B of the concrete U-wall block in a one step manner.

Figure 7M:
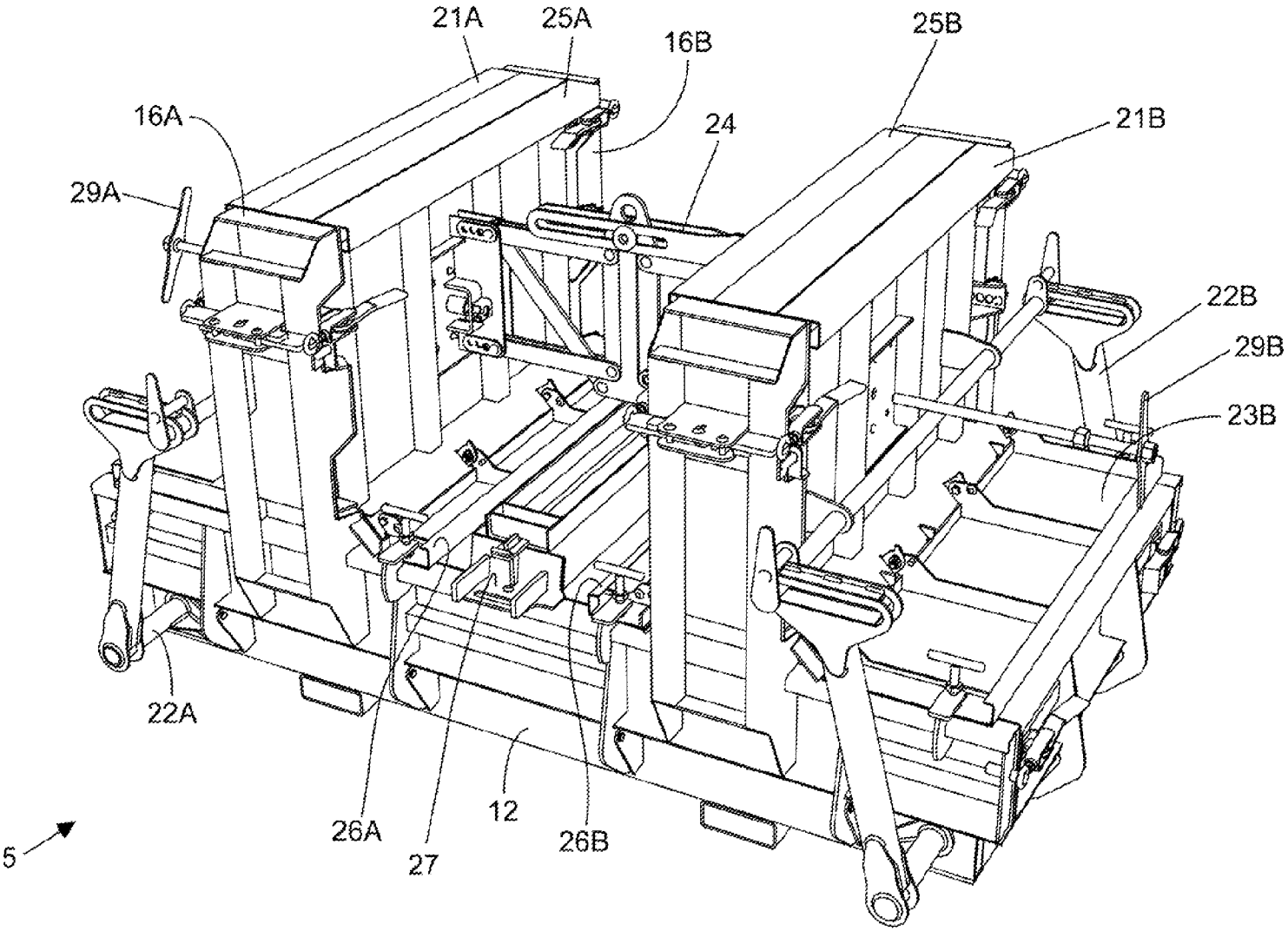
FIG. 7M is a perspective view of the U-wall construction block molding machine of the present invention, showing the stem sections and face section of the cement U-wall construction block formed and contained within the molding assembly of the block molding machine, and the stem wall screws withdrawn ready for removal.
Figure 7N:
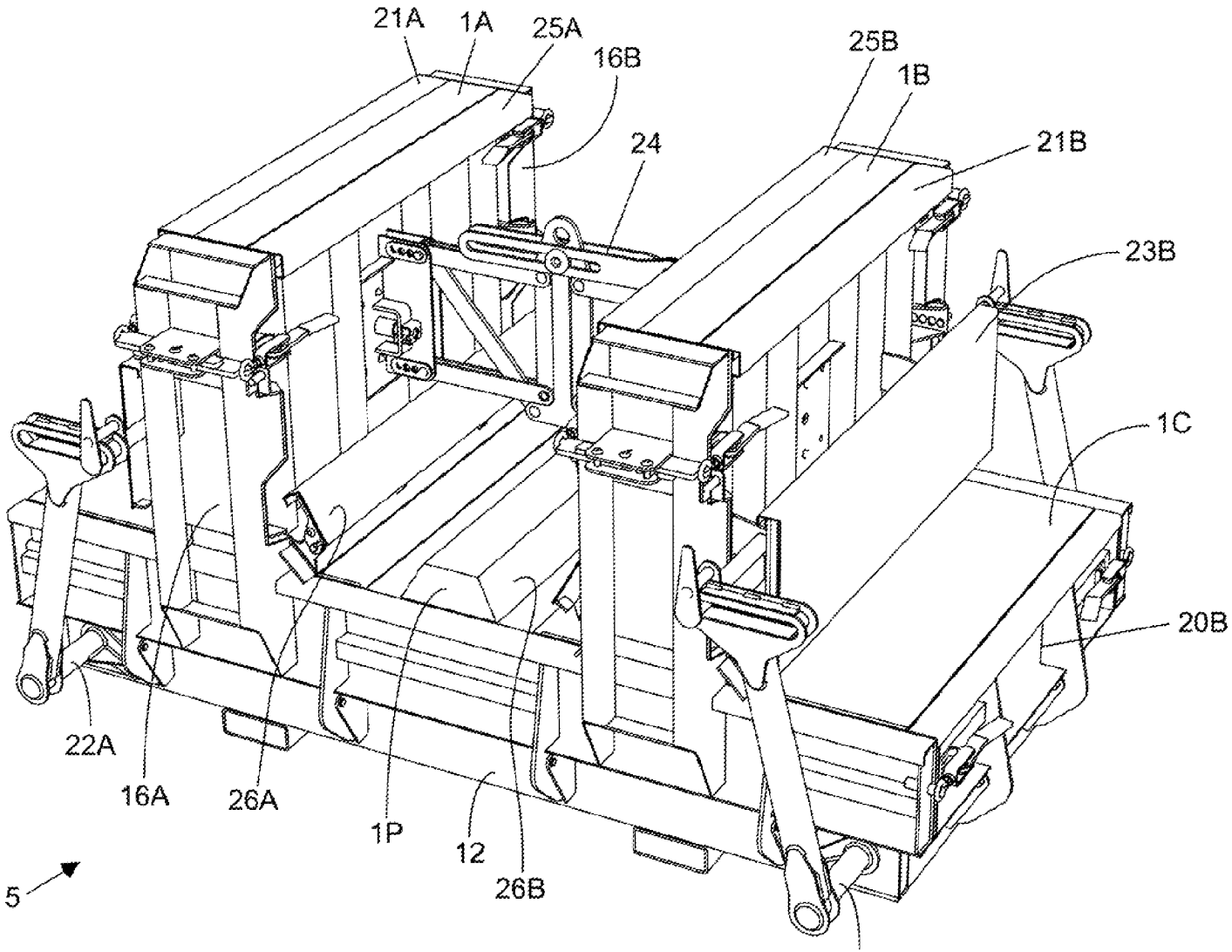
FIG. 7N is a perspective view of the U-wall construction block molding machine of the present invention, showing the center cover panel (i.e. plain or beam style) lifted off and removed from the rear portion of the formed U-wall construction block, and the inner and outer stem jacket pour covers opened and rotated off and away from the rear surfaces of the front section of the formed U-wall concrete block.
Figure 7O:
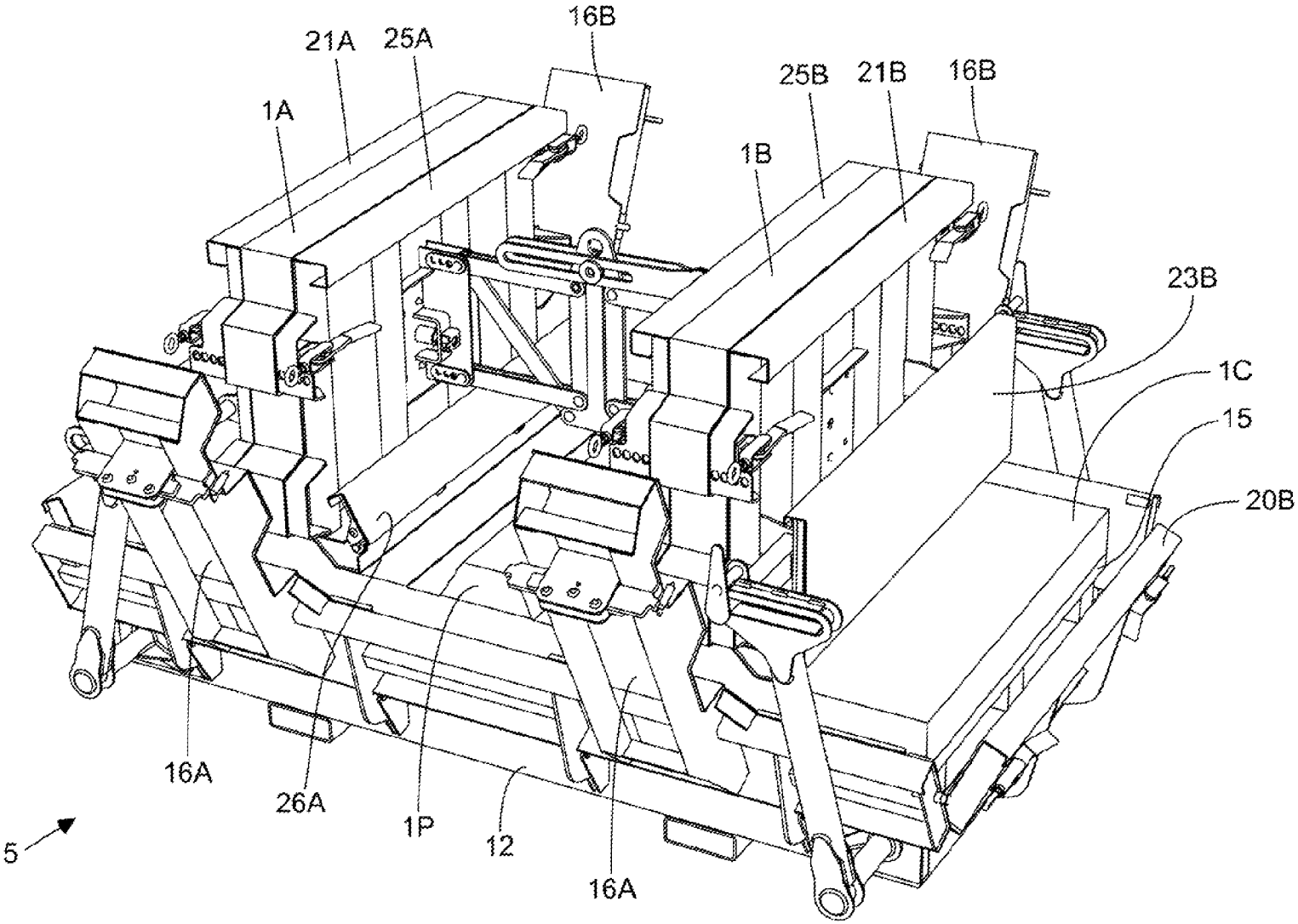
FIG. 7O is a perspective view of the U-wall construction block molding machine of the present invention, showing the side stem jacket panels and rails opened and rotated completely away from the stem sections of the formed U-wall construction block.
Figure 7P:
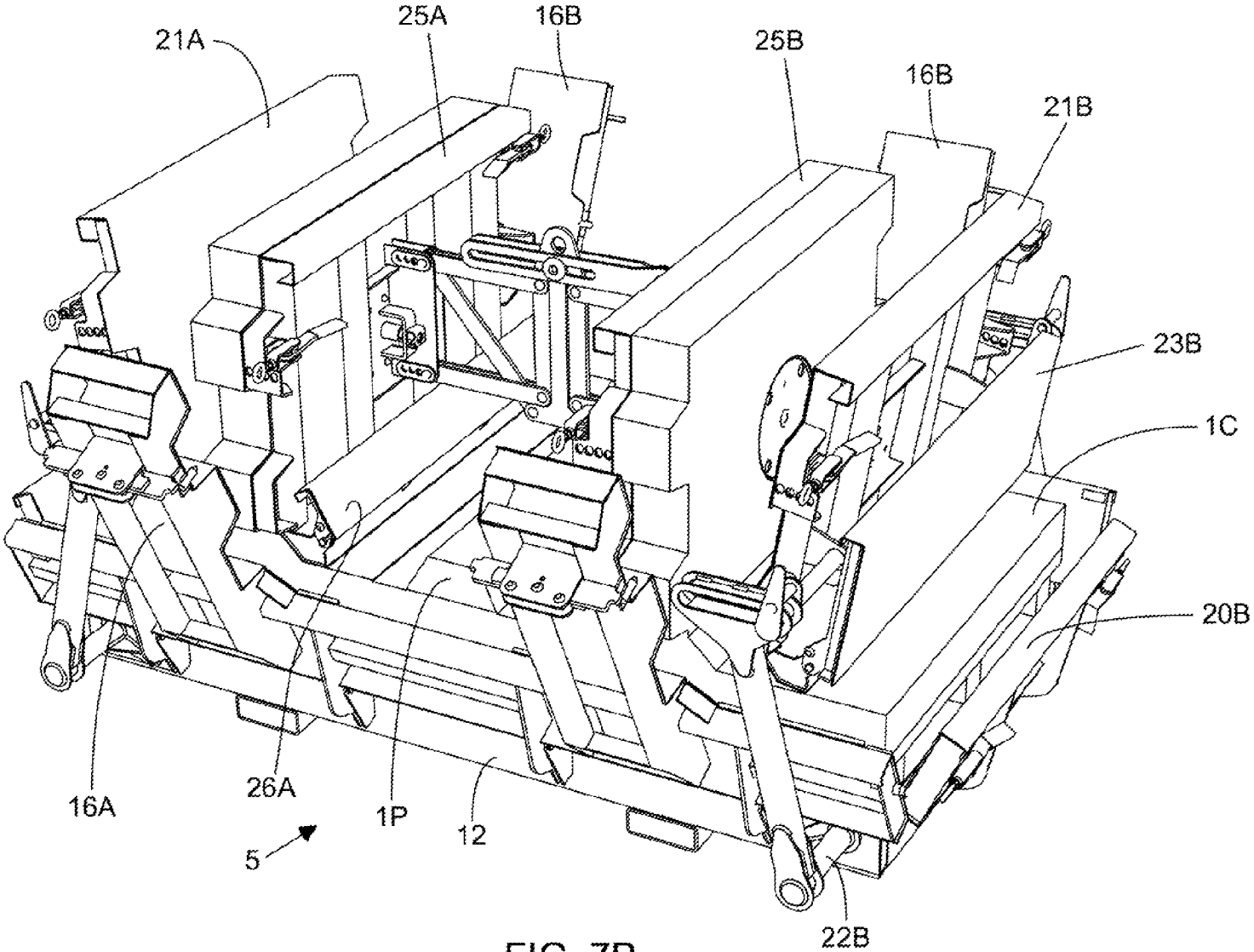
FIG. 7P is a perspective view of the U-wall construction block molding machine of the present invention, showing the outer stem jacket doors/panels rotated partially away from the stem sections of the formed U-wall construction block, while their outer pour covers are rotated upwardly, and the side end rails rotated down and away from the sides of the front wall section of the U-wall concrete block.
Figure 7Q:
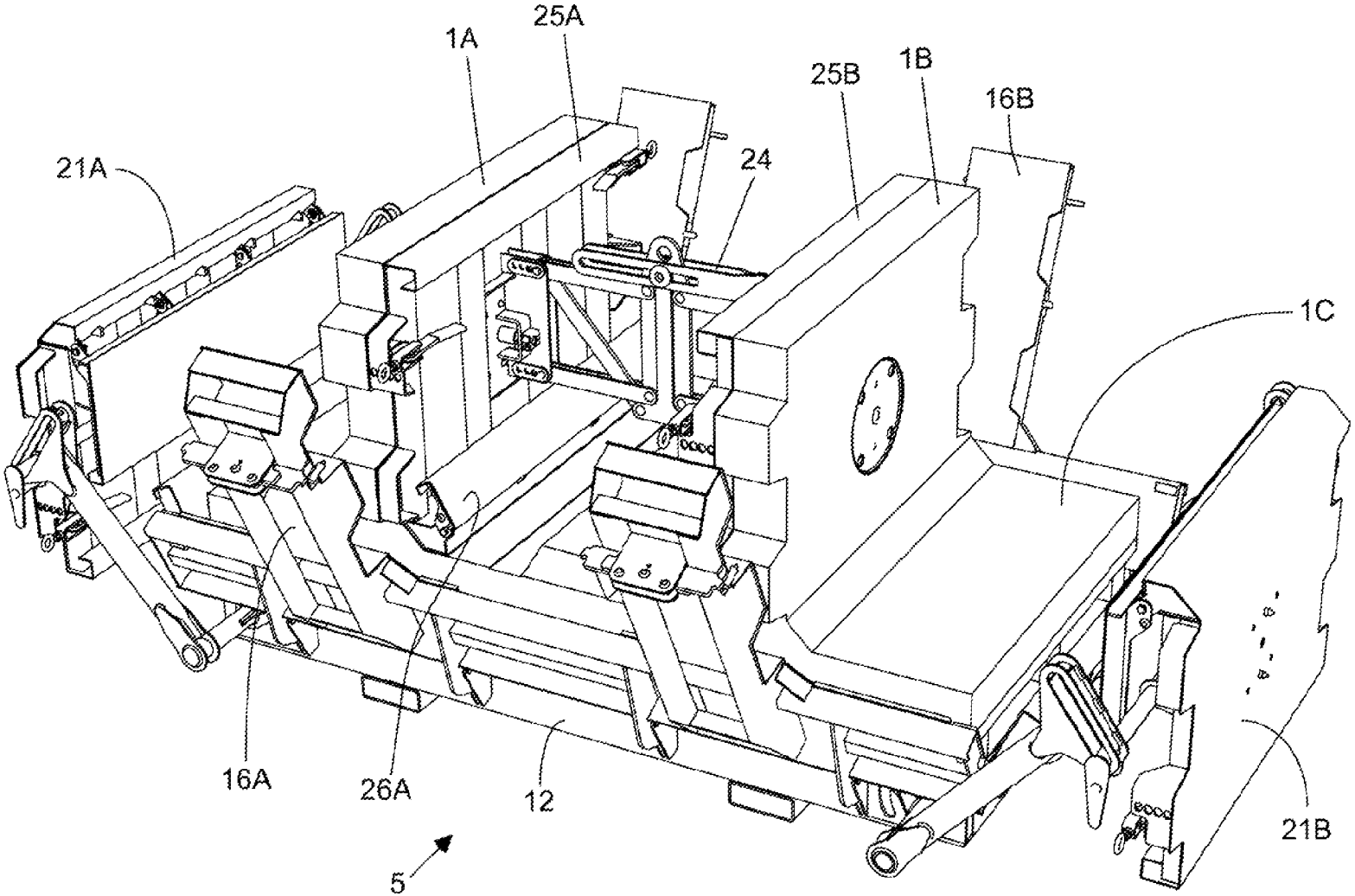
FIG. 7Q is a perspective view of the U-wall construction block molding machine of the present invention, showing the side stem jacket panels moved completely away from the stem sections of the formed U-wall construction block.
Figure 7R:
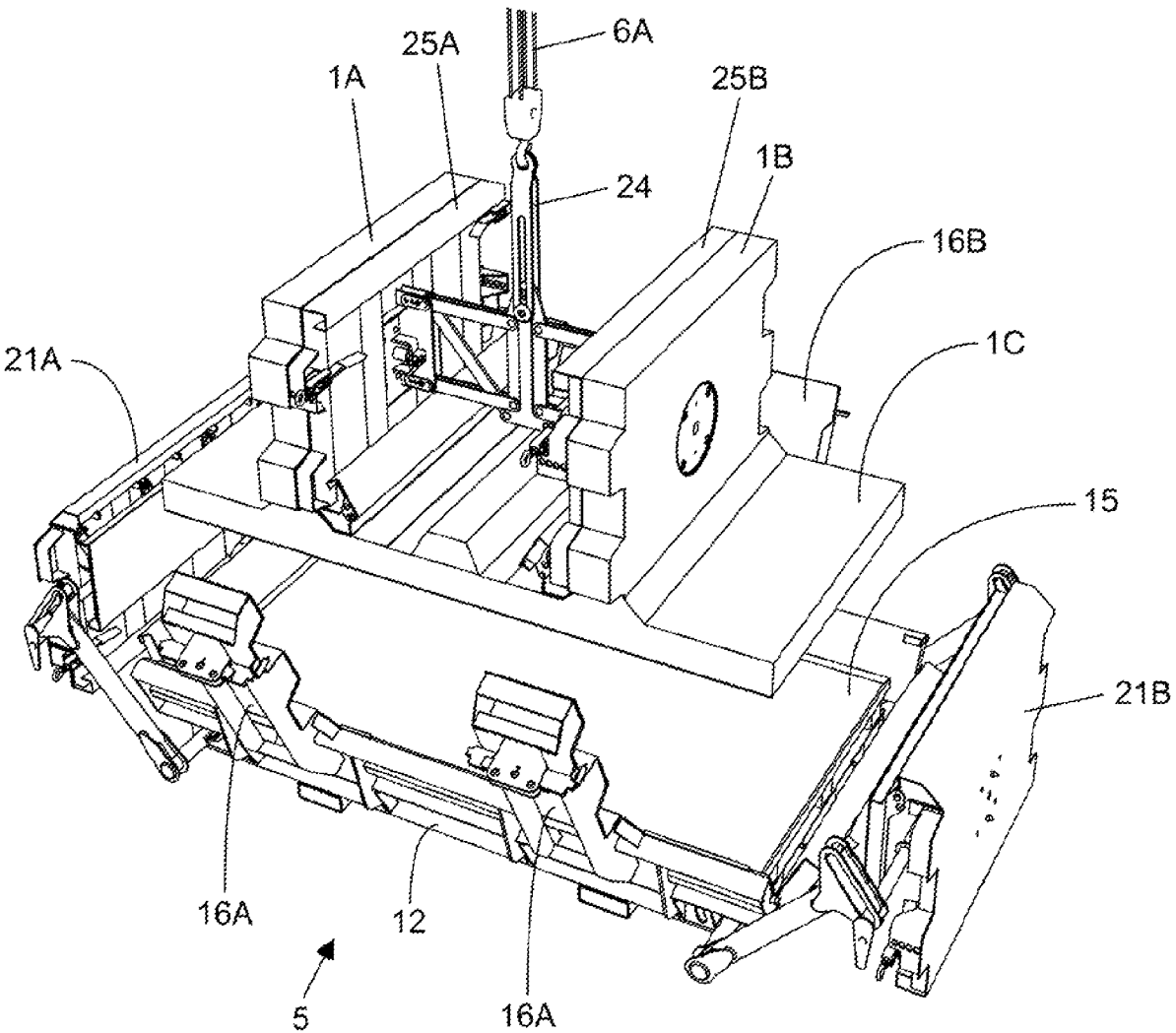
FIG. 7R is a perspective view of the U-wall construction block molding machine of the present invention, showing the formed U-wall construction block, attached to the core molding assembly, being lifted up and out of the molding machine by a crane mechanism connected to the core molding assembly, revealing the front wall face forming liner installed in the molding machine.
Figure 7S:
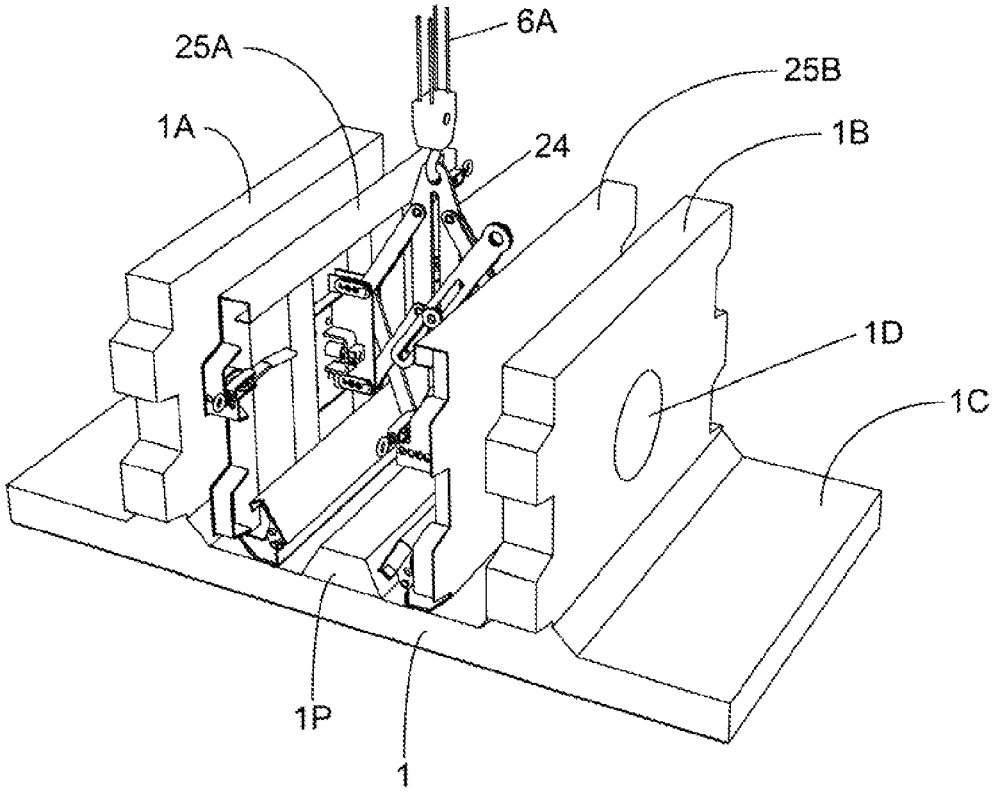
FIG. 7S is a perspective view of the molded concrete U-wall construction block shown supported on a flat surface, with its core molding assembly arranged in its retracted configuration, and disengaged from the U-wall construction block that has been molded within the U-wall construction block molding machine of the present invention, wherein the inner stem jacket panels of the core assembly have been pulled away from the molded stem sections of the U-wall construction block that has been molded within the U-wall construction block molding machine.
Figure 7T:
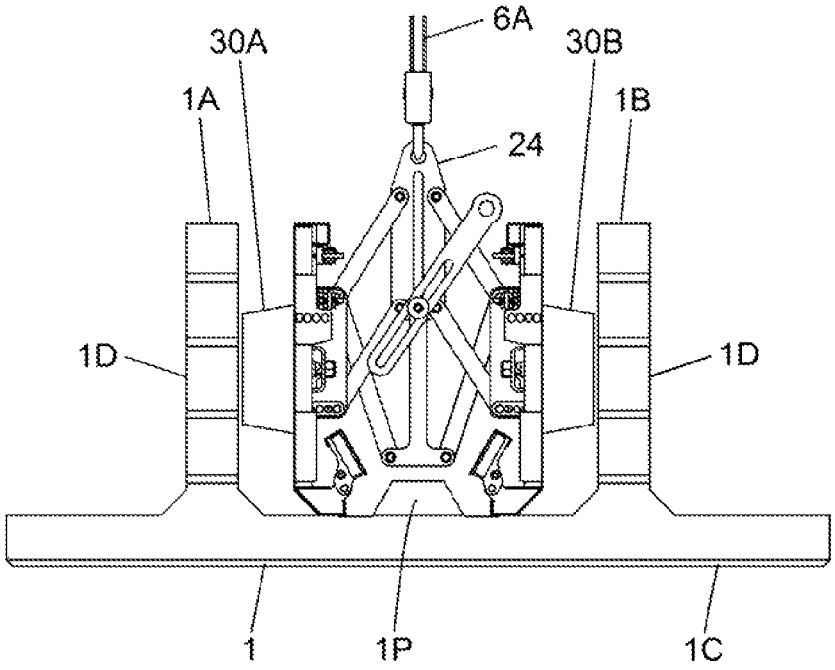
FIG. 7T is an elevated side view of the molded concrete U-wall construction block shown in FIG. 7S, supported on a flat surface, with its core assembly arranged in its retracted configuration, and disengaged from the U-wall construction block that has been molded within the U-wall construction block molding machine of the present invention.
Figure 7U:
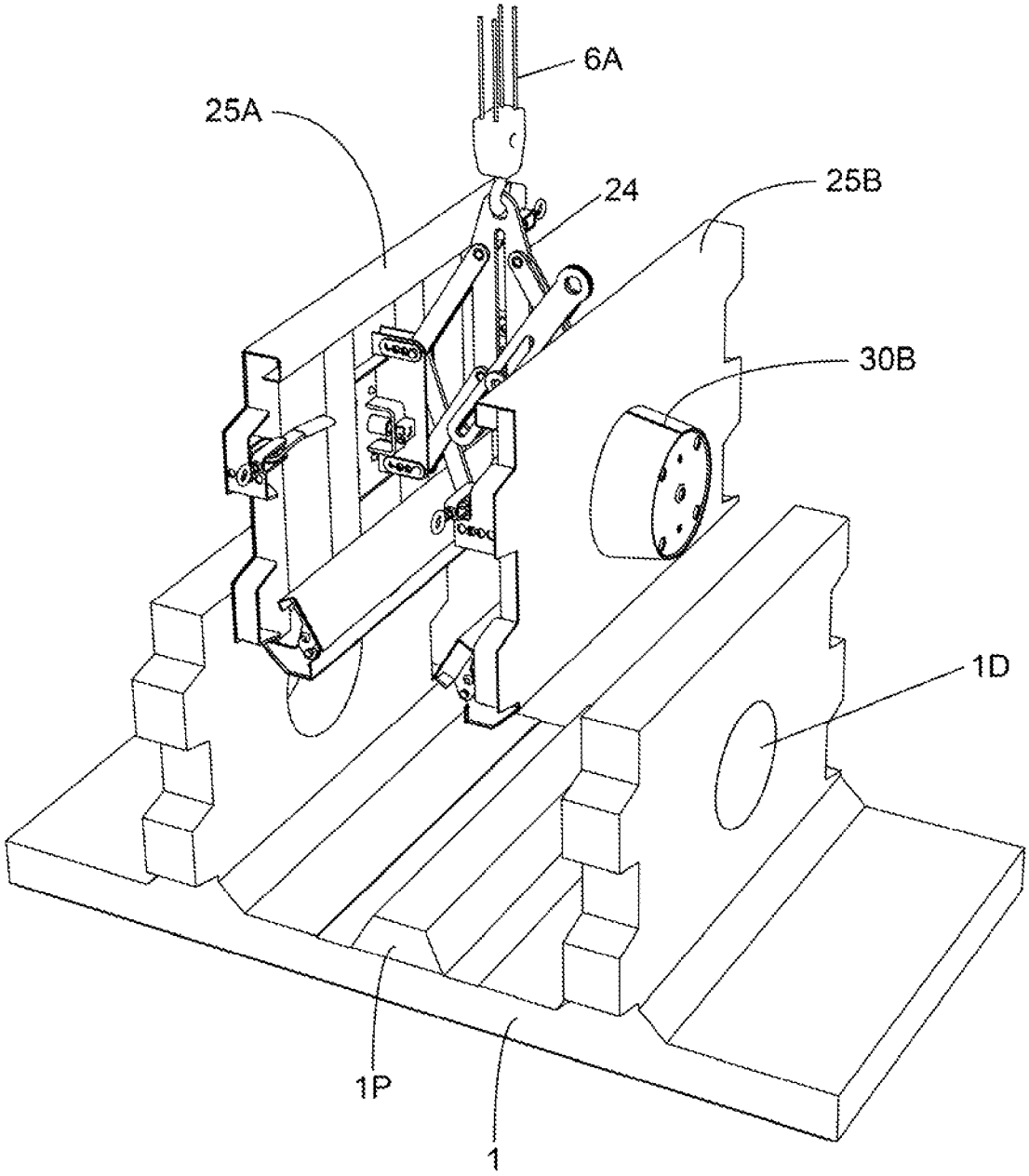
FIG. 7U is a perspective view of the core molding assembly lifted out from the molded concrete U-wall construction block, and the core molding assembly ready for use in manufacturing the next U-wall construction block.

In FIGS. 4A through 4D, the U-wall construction block manufacturing machine 5 is shown arranged in various stages of configuration, required during the manufacture of a concrete U-wall construction block, shown in FIGS. 1A through 1E, according to the manufacturing process illustrated in FIGS. 7A through 7U.

Figure 4B:
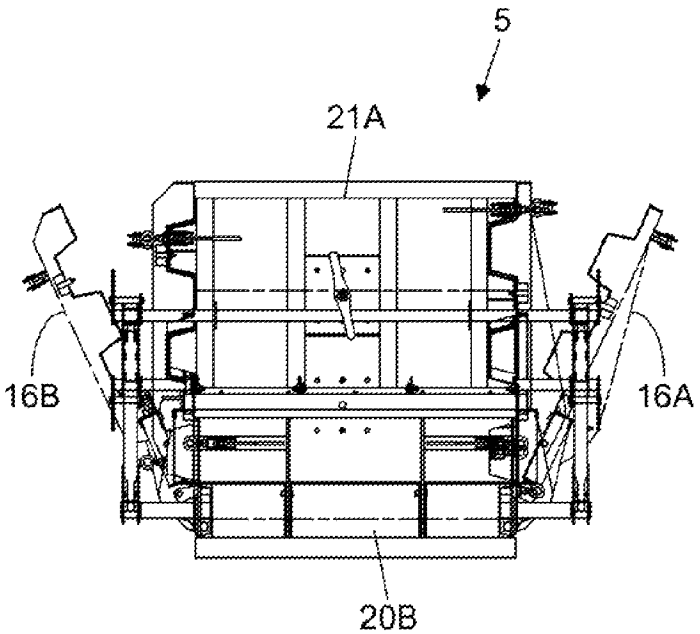
FIG. 4B is an elevated end view of the U-wall construction block molding machine of the present invention, shown arranged in its closed block-molding configuration, and also, showing parts thereof in phantom to show the open cage-loading configuration.
Figure 4A:
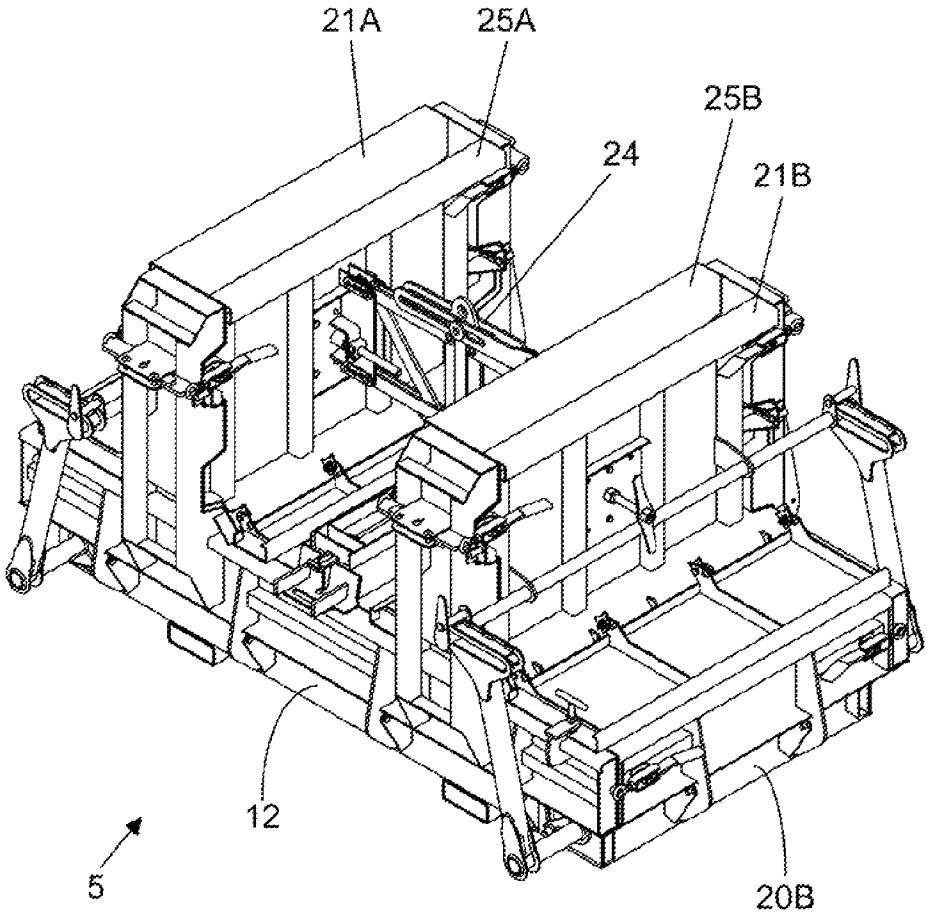
FIG. 4A is a third perspective view of the U-wall construction block molding machine of the present invention, shown arranged in its closed block-molding configuration, but without a block cage loaded into the block molding machine.
Figure 4C:
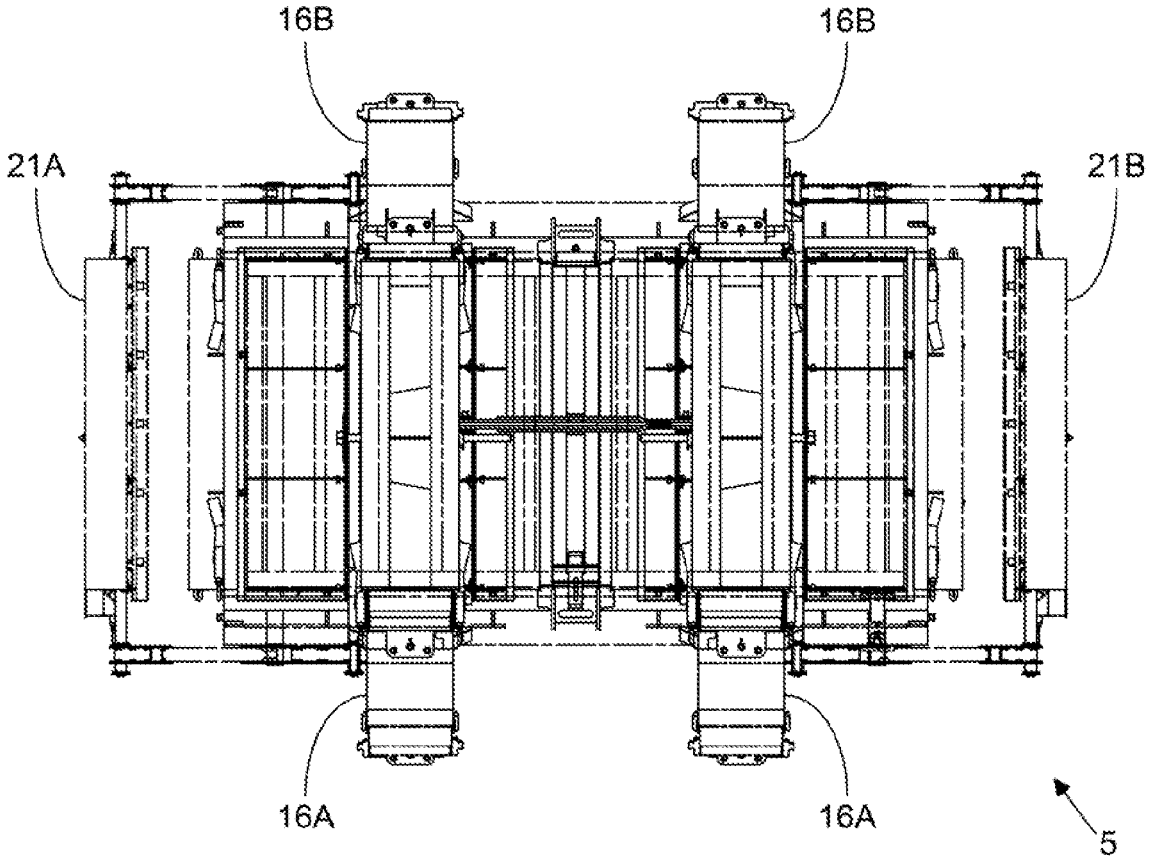
FIG. 4C is a plan view of the U-wall construction block molding machine of the present invention, shown arranged in its closed block-molding configuration, and also, showing parts thereof in phantom to show the open cage-loading configuration.
Figure 4D:
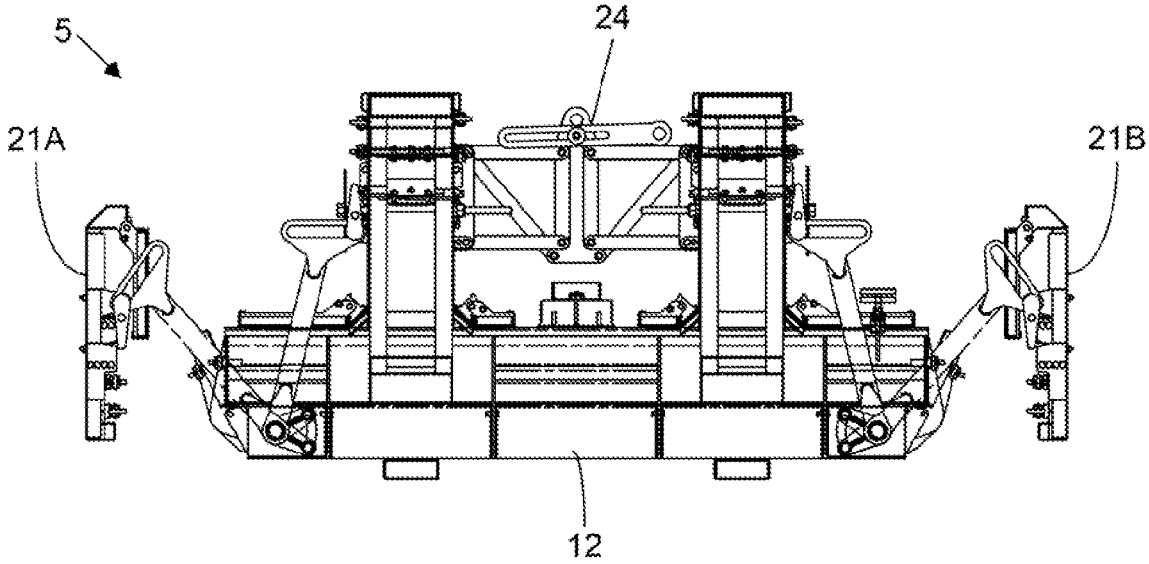
FIG. 4D is a plan view of the U-wall construction block molding machine of the present invention, shown arranged in its closed block-molding configuration, and also, showing parts thereof in phantom to show the open cage-loading configuration.

Specifically, FIG. 4A shows the U-wall construction block molding machine 5 arranged in its block molding configuration, but without a block cage 4 (made of reinforcement steel) loaded into the block molding machine. FIG. 4B shows the U-wall construction block molding machine 5 arranged in its closed block-molding configuration, but without a block cage (i.e. reinforced steel/metal form) 4 loaded into the block molding machine. FIG. 4C shows the U-wall construction block molding machine 5 arranged in its closed block-molding configuration, but without a block cage loaded into the block molding machine. FIG. 4D shows the U-wall construction block molding machine 5 arranged in its closed block-molding configuration, and also, showing parts thereof in phantom to show the open cage-loading configuration. FIG. 4E shows the U-wall construction block molding machine 5 arranged in its closed block-molding configuration, and also, showing parts thereof in phantom to show the open cage-loading configuration. FIG. 4F shows the U-wall construction block molding machine 5 arranged in its closed block-molding configuration, and also, showing parts thereof in phantom to show the open cage-loading configuration. With these states of configuration, the machine 5 is capable of manufacturing U-wall construction blocks having different face panel and stem portion thicknesses, when the machine is configured and set up with slightly different configuration settings, as will be described hereinafter.

Figure 5:
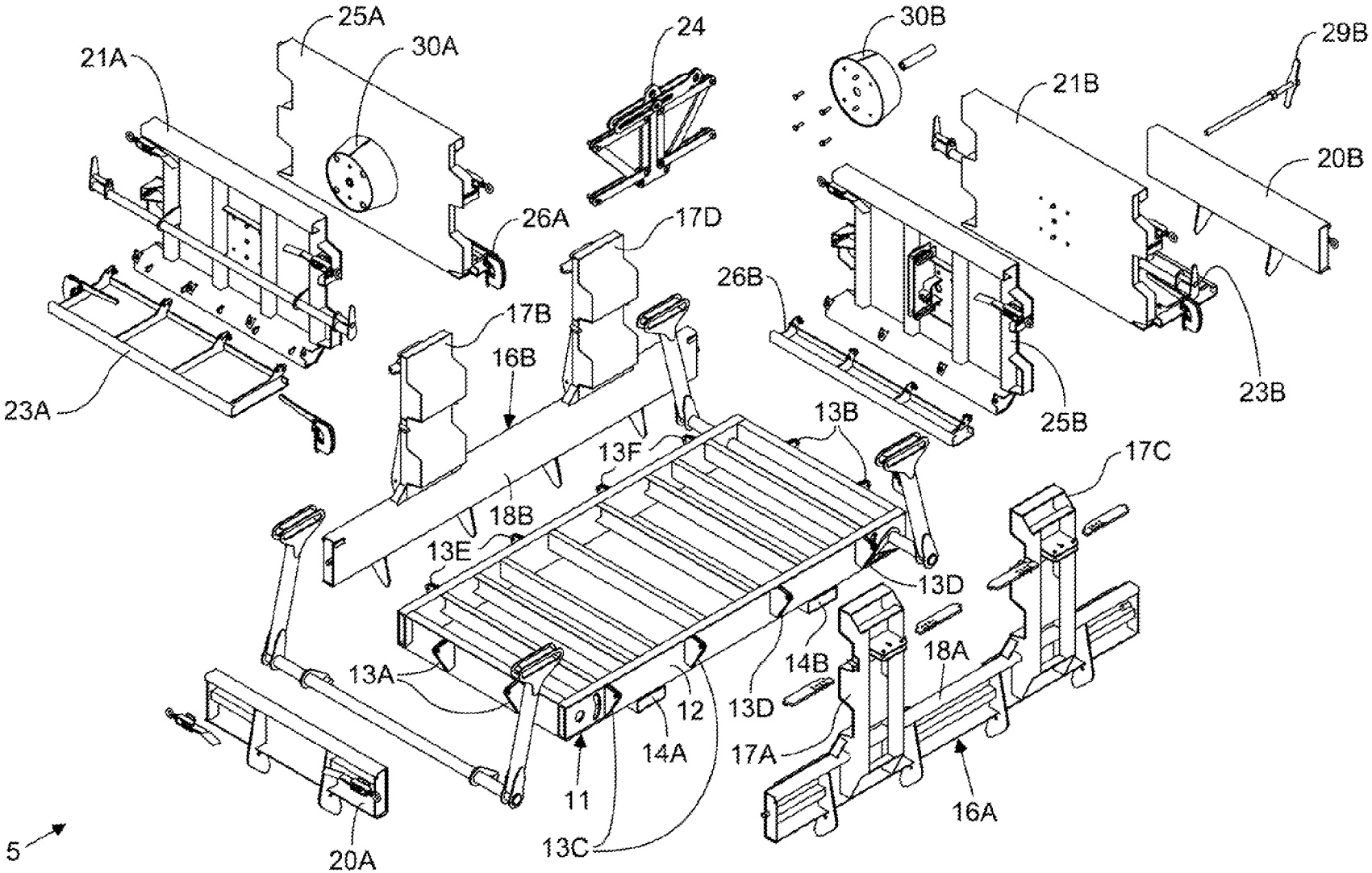
FIG. 5 is an exploded diagram showing the components of the U-wall construction block molding machine of the present invention in a disassembled state.

As shown in FIG. 5, the U-wall construction block molding machine 5 is shown in a disassembled state comprising: a support base 11 having the general rectangular dimensions of the face wall component of a U-wall construction block, and fabricated by steel elements arranged in parallel within a rectangular base support framework 12 supporting six (6) sets of hinge structures 13A through 13F, for hingedly supporting various structures which will be described hereinbelow, and pair of rectangular pipes 14A and 14B through holes formed in the base portion 11 of the framework 12 to allow the machine to be lifted by a fork-lift machine and placed to its proper location within the factory or plant environment 3; a plurality of front wall surface forming liners 15, one of which is installed upon the rectangular base support framework 12 during concrete block molding operations, and having dimensions close thereto and a height dimension which determines the final thickness of the front wall portion of the concrete U-wall block 1 to be molded within the machine 5; first and second side jackets 16A and 16B hingedly connected to hinge mechanisms 13C and 13D, respectively, provided on the sides of the base support framework 12 and having side panels 17A and 17B to form the top and bottom surfaces of the block stem sections, and side rails 18A and 18B for forming the top and bottom side surfaces of the front wall section of the construction block, and the adapted to be (i) rotated against the stem sections of metal cage/form during molding operations shown in FIGS. 4C and 4D during the manufacturing stage shown in FIG. 7D, and (ii) opened and moved completely away from the stem sections of a molded concrete construction block during the manufacturing stage shown in FIG. 7I; first and second end rails 20A and 20B hingedly connected to hinge mechanisms 13A and 13B, respectively, provided on the sides of the base support framework 12, for forming the side surfaces of the front wall section of the construction block, and the adapted to be (i) rotated against the wall section of metal cage/form 4 during molding operations shown in FIG. 4C during the manufacturing stage shown in FIG. 7I, and (ii) opened and moved completely away from the wall section of a molded concrete construction block during the manufacturing stage shown in FIG. 7O; first and second outer stem jacket panels 21A and 21B, supported and guided by first and second rotatable support bars 22A and 22B, respectively, hingedly supported on the sides of the base support framework 12, and adapted for forming the outside surfaces of the stem section of the construction block, and the to be (i) rotated against the outside surface of the stem section of metal cage/form 4 during molding operations shown in FIG. 4C during the manufacturing stage shown in FIG. 7H, and (ii) opened and moved completely away from the stem section of a molded concrete construction block during the manufacturing stage shown in FIGS. 7P, 7Q; inner and outer stem jacket pour covers 23A and 23B hingedly connected to the lower portion of the first and second outer stem jacket doors 21A and 21B, respectively; core molding assembly 10 including a retractable/protractable support mechanism 24 supportable by the hook of a cable wound on the winch of the crane subsystem 6, and adapted for supporting first and second inner stem jacket panels 25A and 25B, in a parallel manner, for forming the inside surfaces of the stem sections of the construction block, and the adapted to be (i) protracted against the stem sections of metal cage/form during molding operations shown in FIG. 4C during the manufacturing stage shown in FIG. 7D, and (ii) retracted and moved completely away from the stem section of a molded concrete construction block during the manufacturing stage shown in FIG. 7T; first and second pour covers 26A and 26B hingedly connected to the lower portions of first and second inner stem jacket panels 25A and 25B, for forming the rear surfaces of the central portion of the wall sections of the construction block, and the adapted to be (i) rotated against the inner stem jacket panels during concrete pouring operations shown in FIG. 7I, and (ii) closed and disposed on top of the rear surface of the wall section of a metal cage when pouring concrete down the stem sections of the cage during the manufacturing stage shown in FIG. 7K; a center cover panel 27 (i.e. plain or beam style) for covering the central region of the rear surface of the wall section of the metal cage 4, disposed between the first and second pour cover panels 26A and 26B, as shown in FIG. 7K; a first stem wall screw 29A that passes through the first inner and outer stem jacket panels 21A and 25A and the stem section of the metal cage 4 disposed therebetween, for the purpose of aligning and releasably the position of such panels during block formation operations; a second stem wall screw 29B that passes through the second inner and outer stem jacket panels 21B and 25B and the stem section of the metal cage 4 disposed therebetween, for the purpose of aligning and releasably the position of such panels during block formation operations; and first and second cylindrical support drums 30A and 30B mounted on the inside surfaces of the first and second inside stem jacket panels 21A and 12B, respectively, for insertion within cylindrical apertures 4A and 4B formed in the stem sections of the metal cage 4, and supporting and lifting the cage and concrete block formed thereabout when the support mechanism 24 is arranged in its protracted configuration as shown in FIG. 7D, and releasing the same when the support mechanism 24 is arranged in its retracted configuration as shown in FIGS. 7C, 7T.

The core molding assembly 10 comprises: first and second inside stem jacket panels 25A and 25B; first and second cylindrical support drums 30A and 30B mounted on the inside surfaces thereof respectively; inner pour covers 26A and 26B hinged to the first and second inside stem jacket panels 25A and 25B, respectively; and retractable/protractable support mechanism 24, described above. As shown, the retractable/protractable support mechanism 24 in the core molding assembly 10 can be easily adjusted so that the distance between the first and second inside stem jacket panels 25A and 25B can be spaced apart in discrete intervals, and then locked into position, to determine the thickness of each stem section (e.g. 6", 8" or 12") of a concrete block 1 to be molded in the machine of the present invention. This thickness will be selected to match the thickness specified for the front wall portion of the concrete block 1, which is determined by the height of the front wall surface forming liner 15 that is installed on top of the support base framework 12 of the machine 5 shown in FIG. 7E. Each front wall surface forming liner 15 can made from rugged plastic material (e.g. polyurethane), metal material, wood material, and/or any other suitable material that can withstand the hydrostatic forced generated by the weight of poured concrete into the molding machine 5, when the stem sections thereof are completely filled with wet poured concrete. To provide a desired surface texture to the front surface of the formed U-wall construction block, a surface texture and/or patterning will be provided to the top surface of the front wall surface forming liner 15.

In FIGS. 6A through 6D, the preferred method of manufacturing cement u-wall construction blocks is described using the U-wall construction block molding machine 5 shown in FIGS. 4A through 5.

For purposes of illustration, the last few steps of the block manufacturing process are shown, where in FIG. 7A the core molding assembly 10 is disengaged from the U-wall construction block, by retracting its inside stem jacket panels 21A, 21B away from the stem sections of the concrete construction block. Then as shown in FIG. 7B, the core molding assembly 10 is lifted up and away from the U-wall construction block, to become free and available to engage with a new metal cage 4 as shown in FIGS. 7C and 7D. It is at this stage, the beginning of the manufacturing process shall be described.

Figure 6A:
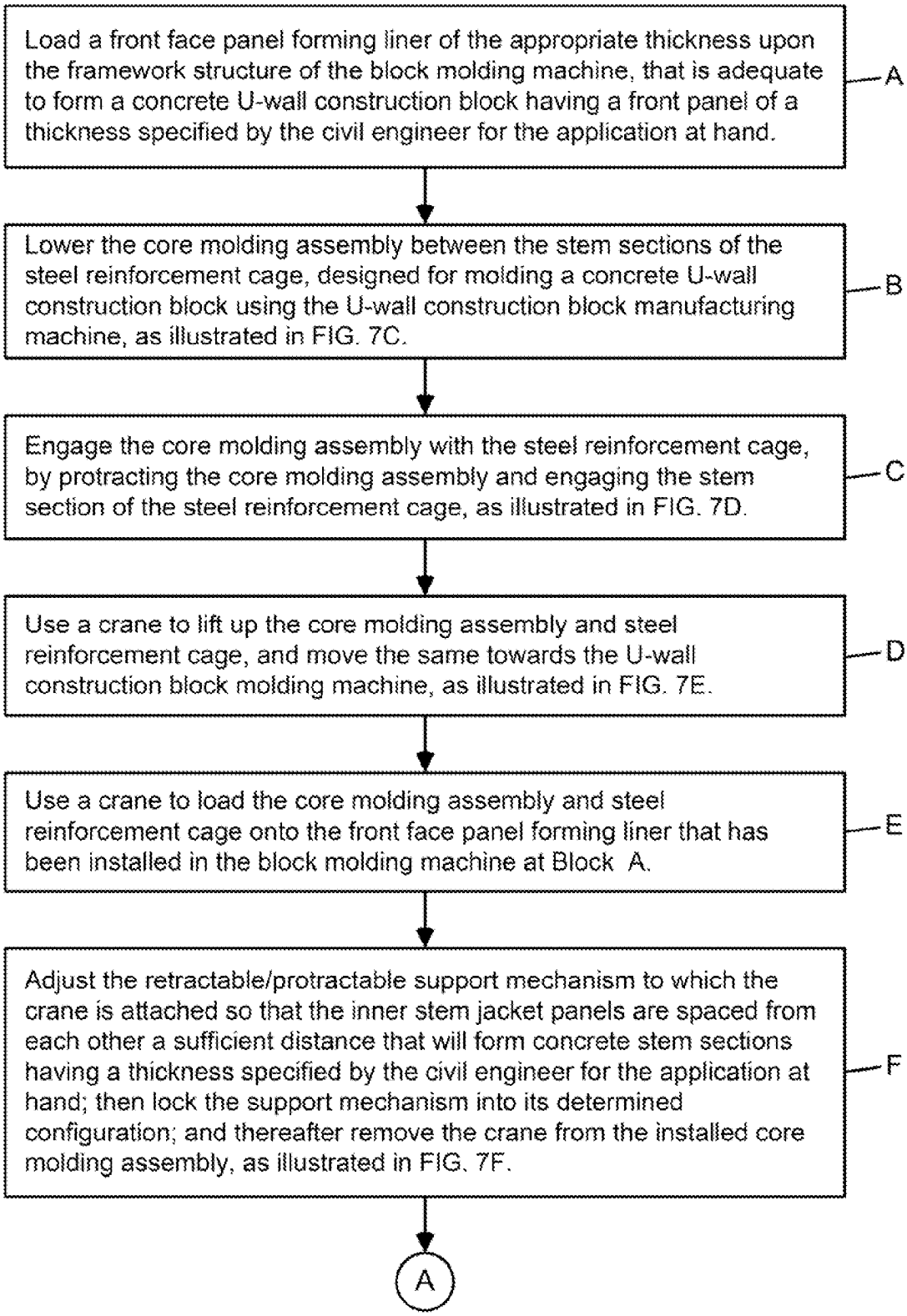
FIGS. 6A through 6D set forth a flow chart describing steps involved during manufacture of cement U-wall construction blocks using the U-wall construction block molding machine of the present invention.

As indicated at Block A in FIG. 6A, a front face panel forming liner of the appropriate thickness is loaded upon the framework structure of the block molding machine, that is adequate to form a concrete U-wall construction block having a front panel of a thickness specified by the civil engineer for the application at hand.

As indicated at Block B in FIG. 6A, the core molding assembly 10 is lowered between the stem portions of the steel reinforcement cage 4 designed for the concrete U-wall construction block 1 to be manufactured using the block molding machine 5, as shown in FIG. 7C.

As indicated at Block C in FIG. 6A, the core molding assembly engages with the central apertures formed in the stem portions of the steel reinforcement cage 4, for the U-wall construction block to be manufactured, as shown in FIG. 7D.

As indicated at Block D in FIG. 6A, the crane subsystem 6 is used to lift and move the core molding assembly and steel reinforcement cage 4 towards and above the U-wall construction block molding machine 5, while the core molding assembly 10 is arranged in its open (i.e. protracted) cage-loading configuration, as shown in FIG. 7E.

As indicated at Block E in FIG. 6A, the crane subsystem 6 loads the core molding assembly and steel reinforcement cage (for a U-wall construction block) onto the front face panel forming liner 15 that has been previously installed in the block molding machine 5 at Block A (based on design specifications for the concrete block to be molded), while the core molding assembly is its arranged in its protracted cage-loading configuration, and thereafter the crane is removed from the installed core molding assembly, as shown in FIG. 7F.

As indicated at Block F in FIG. 6A, the retractable/protractable support mechanism 24 to which the crane is attached is adjusted so that the inner stem jacket panels 25A and 25B are spaced from each other a sufficient distance that will form concrete stem sections having a thickness specified by the civil engineer for the application at hand; the support mechanism 24 is locked into its determined configuration; and thereafter the crane 6 is disconnected and removed from the installed core molding assembly 10, as illustrated in FIG. 7F.

Figure 6B:
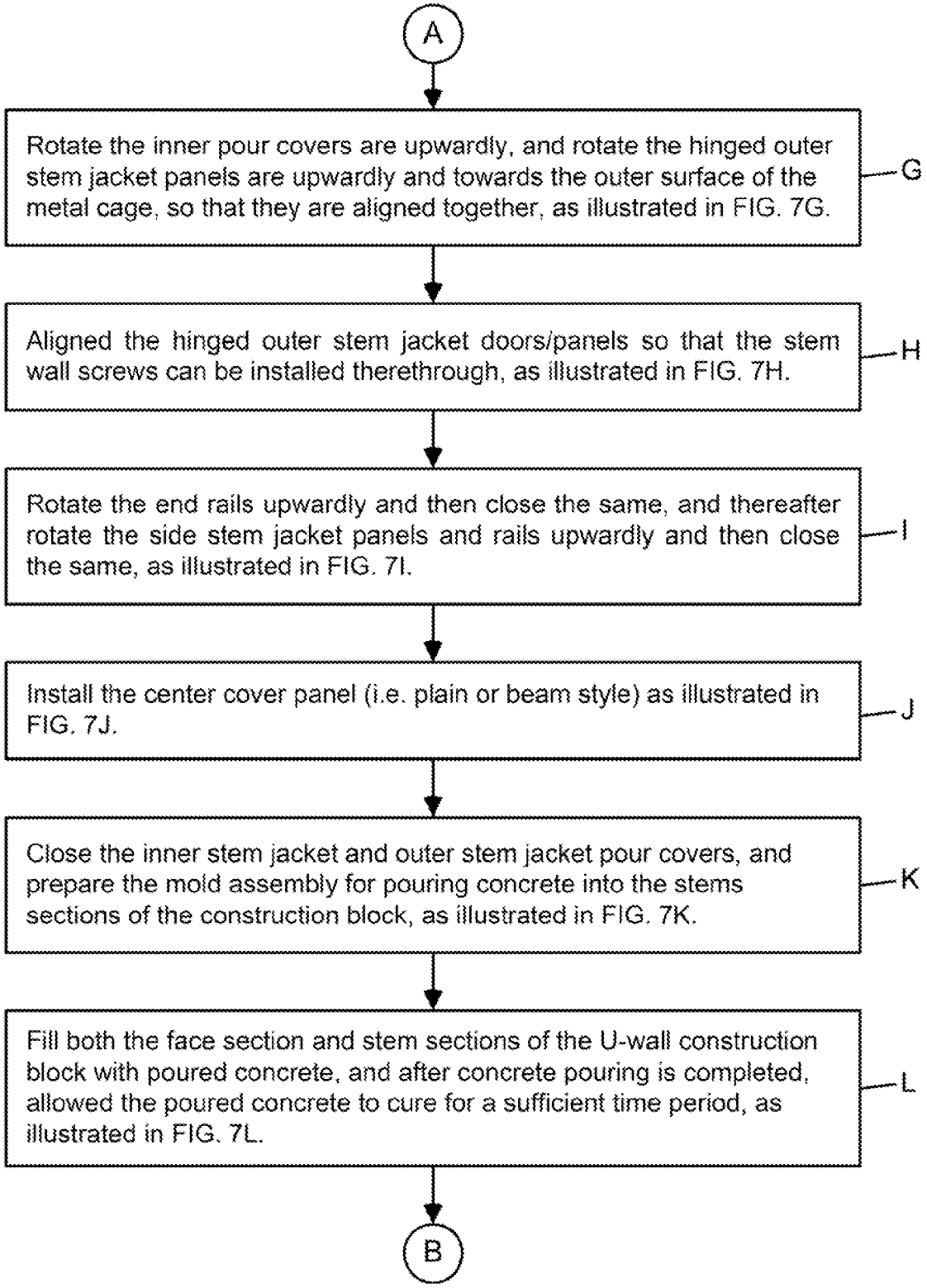

As indicated at Block G in FIG. 6B, the inner pour covers 26A and 26B are rotated upwardly, and the hinged outer stem jacket panels 21A and 21B are rotated upwardly and towards the outer surface of the metal cage 4, and are aligned together, as illustrated in FIG. 7G.

Figure 6C:
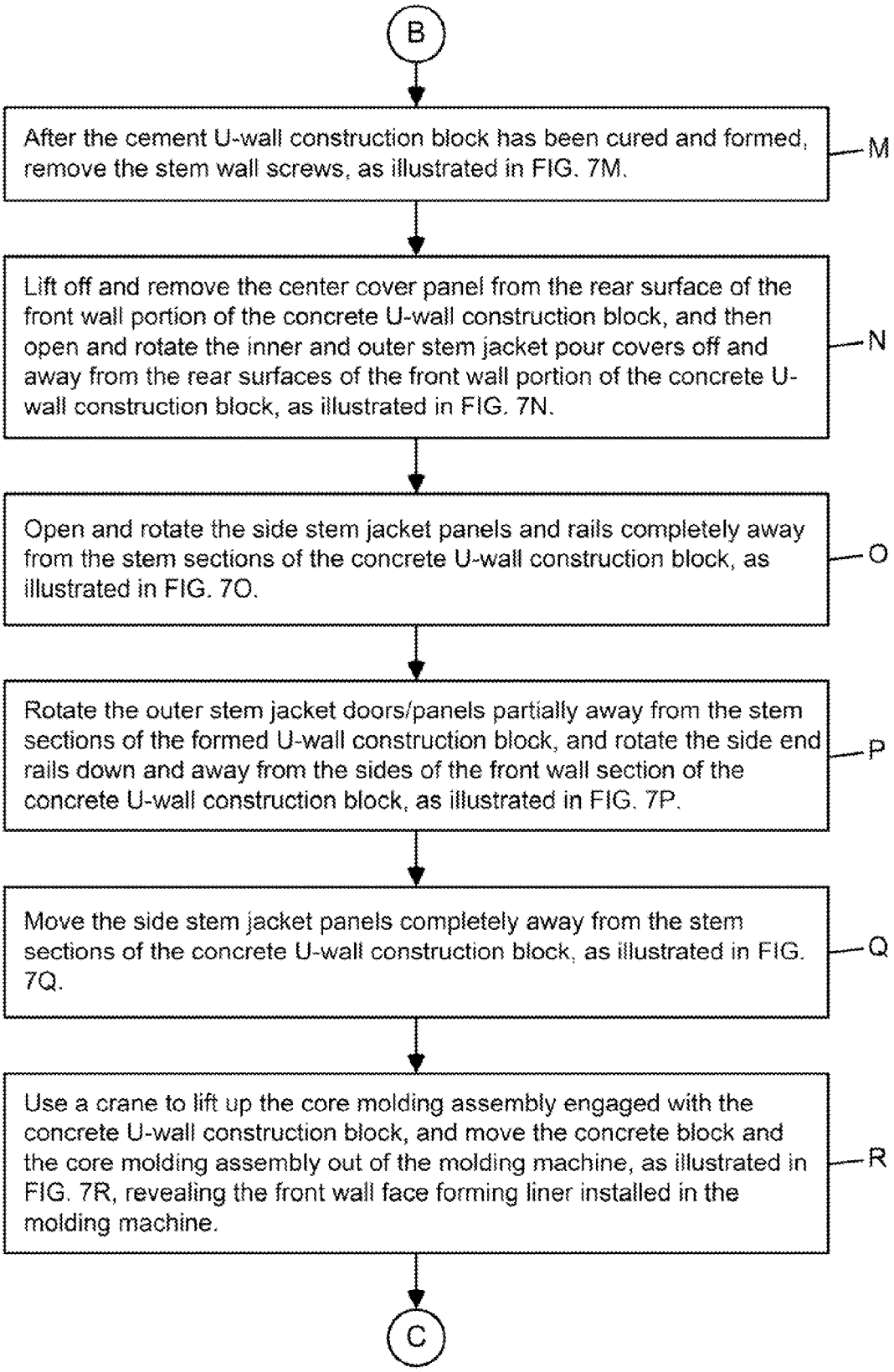
Figure 6D:
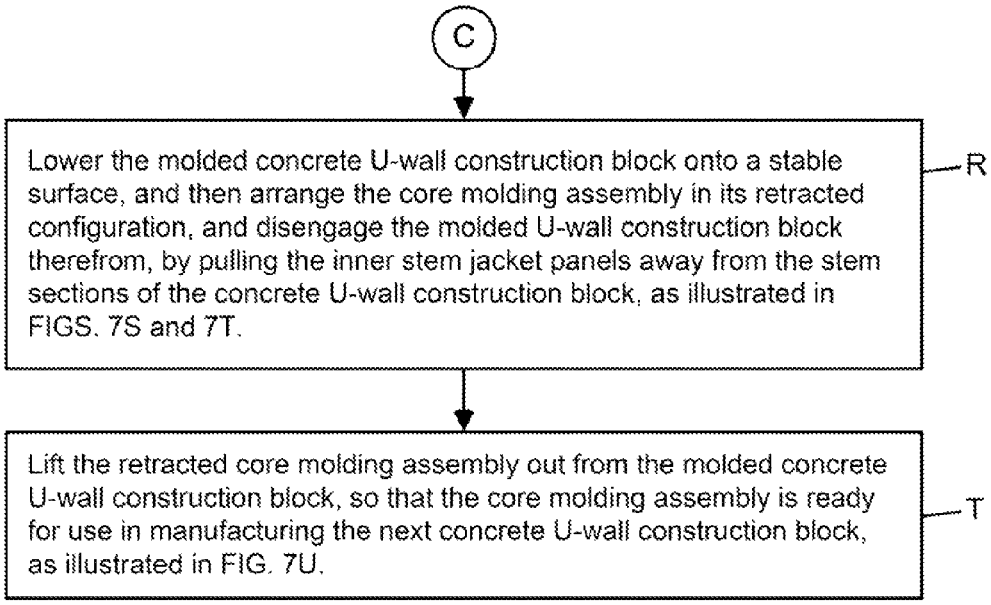

As indicated at Block H in FIG. 6, the hinged outer stem jacket doors/panels 21A and 21B are aligned so that the stem wall screws 29A and 29B can be installed, as illustrated in FIG. 7H.

As indicated at Block I in FIG. 6B, the end rails 20A and 20B are rotated upwardly and closed, and the side stem jacket panels and rails 16A and 16B are rotated upwardly and closed, as illustrated in FIG. 7I.

As indicated at Block J in FIG. 6B, the center cover panel (i.e. plain or beam style) 27 is installed over the central rear region of the front wall mold structure, as shown in FIG. 7J.

As indicated at Block K in FIG. 6B, the inner stem jacket and outer stem jacket pour covers are closed, and the mold assembly is prepared to pour concrete into the stems sections of the construction block, as illustrated in FIG. 7K.

As indicated at Block L in FIG. 6B, both the face section and stem sections of the U-wall construction block have been filled (i.e. poured) with concrete after the concrete pouring process completed, and the concrete is allowed to cure for a sufficient time period, as illustrated in FIG. 7L.

As indicated at Block M in FIG. 6C, after the cement U-wall construction block has been cured and formed, the stem wall screws are withdrawn ready for removal, as illustrated in FIG. 7M.

As indicated at Block N in FIG. 6C, the center cover panel (i.e. plain or beam style) 27 is lifted off and removed from the rear portion of the formed U-wall construction block, and the inner and outer stem jacket pour covers 23A and 23B and 26A and 26B are opened and rotated off and away from the rear surfaces of the front section of the formed U-wall concrete block, as shown in FIG. 7N.

As indicated at Block O in FIG. 6C, the side stem jacket panels and rails are opened and rotated completely away from the stem sections of the formed U-wall construction block, as illustrated in FIG. 7O.

As indicated at Block P in FIG. 6C, the outer stem jacket doors/panels are rotated partially away from the stem sections of the formed U-wall construction block, while their outer pour covers are rotated upwardly, and the side end rails are rotated down and away from the sides of the front wall section of the U-wall concrete block, as illustrated in FIG. 7P.

As indicated at Block Q in FIG. 6C, the side stem jacket panels are moved completely away from the stem sections of the formed U-wall construction block, as illustrated in FIG. 7Q.

As indicated at Block R in FIG. 6C, the formed U-wall construction block, attached to the core molding assembly, is lifted up and out of the molding machine by a crane mechanism connected to the core molding assembly, as illustrated in FIG. 7R, revealing the front wall face forming liner installed in the molding machine.

As indicated at Block S in FIG. 6D, molded concrete U-wall construction block is lowered onto a stable surface, and then the core assembly is arranged in its retracted configuration, and disengaged from the molded U-wall construction block, by pulling the inner stem jacket panels away from the stems of the formed concrete U-wall block, as illustrated in FIGS. 7S and 7T.

As indicated at Block D in FIG. 6D, the core molding assembly is lifted out from the molded concrete U-wall construction block, as illustrated in FIG. 7U, and the core molding assembly is now ready for use in manufacturing the next U-wall construction block.

Using the U-wall block manufacturing machine of the present invention, concrete U-wall type wall construction blocks are molded so that the front wall portion thereof is facing downwardly toward the horizontal support surface, while wet concrete is poured vertically down the stem portions of the metal reinforcement cage (i.e. block mold) during the molding process.

Using the U-wall block manufacturing machine of the present invention, concrete U-wall construction blocks can be molded to have different front wall panel thickness (e.g. 6", 8" or 12") and stem section thicknesses by (i) installing a front wall surface liner 15 in the block manufacturing machine, having a suitable thickness, and (ii) adjusting the spacing between the inner stem jacket panels 25A and 25B employed in the core molding assembly 10 of the present invention.

Using the U-wall block manufacturing machine of the present invention, concrete U-wall construction blocks can be formed with a reinforcing thickness portion in the rear central region of the front panel portion of the U-wall construction block, by installing a center cover panel 27 of suitable geometry between the inner pour cover panels 26A and 26B hingedly connected to the core molding assembly 10 employed in the U-wall block manufacturing machine of the present invention.

Manufacturing concrete U-wall construction blocks according to the present invention results in a reduction of human labor. Also, when the method and machine of the present invention are operated under full computer-based automation and control, a fully-automated robotic block manufacturing factory is provided, requiring a minimum number of human operators, and resulting in lower manufacturing costs, higher efficiencies, and higher quality control standards, during block manufacturing and inspection operations.

The use of reinforced steel cages having stem portions with central apertures allow the cylindrical support structures 30A and 30B of the central molding assembly 10 to securely engage the steel cage 4 and load the same into the block manufacturing machine.

While particular embodiments shown and described above have been proven to be useful in many applications in the retaining wall art, further modifications of the present invention herein disclosed will occur to persons skilled in the art to which the present invention pertains and all such modifications are deemed to be within the scope and spirit of the present invention defined by the appended claims.

What is claimed is:

1. A machine for molding a concrete U-wall construction block from concrete poured about a block cage made from reinforcing material while said block cage is loaded within said machine, wherein each said concrete U-wall construction block molded by said machine has (i) a front wall panel of solid prismatic construction having a front wall surface, a rear wall surface, side wall surfaces, and top and bottom wall surfaces, and (ii) a pair of stem portions of solid prismatic construction, arranged in a parallel manner, and protruding from the rear surface of said front wall panel in a substantially perpendicular manner, wherein each said stem portion has a back surface, an inner side surface, an outer side surface, an upper surface, and a lower surface, and a central aperture formed in each stem portion of the concrete U-wall construction block being manufactured during a set of concrete block molding operations, wherein the front wall panel has a central portion disposed between said pair of stem portions, and a pair of end portions extending from said central portion;

wherein the block cage has (i) a front wall reinforcing portion for reinforcing the front wall panel of the concrete U-wall construction block and having a central region, and (ii) a pair of stem reinforcing portions connected to said front wall reinforcing portion about said central region, for reinforcing the pair of stem portions of the concrete U-wall construction block being manufactured during said set of concrete block molding operations, wherein a central aperture is formed in each one of said pair of stem reinforcing portions, and wherein said machine has several states of configuration including an open block cage loading configuration, a closed concrete block molding configuration, and an open concrete block unloading configuration, said machine comprising:

a support base, supported on a horizontal support surface, and having a plurality of sides and supporting a replaceable front surface forming liner disposed substantially parallel to the horizontal support surface, and having general rectangular dimensions corresponding to the dimensions of the front wall surface of said concrete U-wall construction block being manufactured during said set of concrete block molding operations;

first and second side panels rotatably connected to first and second sets of hinge mechanisms, respectively, provided on the sides of said support base, and providing molding surfaces for forming the top and bottom wall surfaces of the front wall panel of said concrete U-wall construction block being manufactured during said set of concrete block molding operations;

third and fourth end side panels rotatably connected to third and fourth sets of hinge mechanisms, respectively, provided on the sides of said support base, and providing molding surfaces for forming the side wall surfaces of the front wall panel of said concrete U-wall construction being manufactured during said set of concrete block molding operations;

first and second side stem jacket panels supported by said first and second side panels respectively, and moving therewith, and providing molding surfaces for forming the upper and lower surfaces of the stem portions of said concrete U-wall construction block being manufactured during said set of concrete block molding operations;

first and second outer stem jacket panels supported and guided by first and second rotatable support structures, respectively, rotatably supported on the sides of the support base, and providing molding surfaces for forming the outer side surfaces of the stem portions of the concrete U-wall construction block being manufactured during said set of concrete block molding operations, wherein said first and second outer stem jacket panels each have a lower portion;

first and second outer pour cover panels rotatably connected to the lower portion of said first and second outer stem jacket panels, respectively, and moving therewith, and providing molding surfaces for forming the rear wall surfaces of the front wall panel of the concrete U-wall construction block being manufactured during said set of concrete block molding operations;

a core molding assembly moved into position within said machine using a crane system, and having a retracted configuration and a protracted configuration, said core molding assembly including (i) first and second inner stem jacket panels providing molding surfaces for forming the inner side surfaces of said stem portions of the concrete U-wall construction block being manufactured, and wherein said first and second inner stem jacket panels each have a lower portion, (ii) a support mechanism supportable by a cable wound on a winch associated with said crane system and supporting said first and second inner stem jacket panels in a parallel manner, and adapted to (i) engage with the stem sections of the block cage when said support mechanism is configured in said protracted configuration, and (ii) disengage from and moved away from the stem section of the concrete U-wall construction block when said support mechanism is configured in said retracted configuration, and (iii) first and second support members mounted on the molding surfaces provided by said first and second inner stem jacket panels, respectively, and (iv) first and second inner pour cover panels rotatably connected to the lower portions of said first and second inner stem jacket panels, providing molding surfaces for forming the rear wall surfaces of the central portion of the front wall panel of the concrete U-wall construction block being manufactured during said set of concrete block molding operations, wherein, when said support mechanism is arranged in said protracted configuration, said first and second support members are inserted within the central apertures formed in the stem sections of the block cage used to manufacture the concrete U-wall construction block within said machine, and (i) supporting the block cage while said block cage is being loaded into said machine configured in said open block cage loading configuration during a set of block cage loading operations, and also (ii) lifting the concrete U-wall construction block while the concrete U-wall construction block is being unloaded from said machine configured in said open concrete block unloading configuration during a set of concrete block unloading operations, and wherein, when said support mechanism is arranged in said refracted configuration, said first and second support members are withdrawn from said central apertures formed in the stem portions of the concrete U-wall construction block after the concrete U-wall construction block has been unloaded from said machine configured in said open concrete block unloading configuration during said set of concrete block unloading operations; and a center pour cover panel for positioning between said first and second inner pour cover panels, to cover the central region of the rear surface of the front wall reinforcing portion of the loaded block cage when said machine is configured in said closed concrete block molding configuration during said set of concrete block molding operations, and providing molding surfaces to form the rear wall surface of the front wall panel of the concrete U-wall construction block being manufactured during said set of concrete block molding operations.

2. The machine of claim 1, wherein when said machine is arranged in said open block cage loading configuration, said first and second side panels are arranged and moved away to allow for the loading of the block cage during said set of block cage loading operations;

said third and fourth side panels are arranged and moved away to allow for the loading of the block cage during said set of block cage loading operations;

said first and second side stem jacket panels are arranged and moved away to allow for the loading of the block cage during said set of block cage loading operations;

said first and second outer stem jacket panels, and said first and second outer pour covers are arranged and moved away to allow for the loading of the block cage during said set of block cage loading operations;

said center pour cover panel is moved away to allow for the loading of the block cage during said set of block cage loading operations; and said core molding assembly is moved away from said machine, whereupon, said front wall surface molding liner is installed within said machine, and thereafter, the block cage to be used to mold the concrete U-wall construction block, is loaded within said machine during said set of block cage loading operations;

wherein, during said block cage loading operations, said core molding assembly is arranged in said protracted configuration, and said first and second support members are inserted within the pair of central apertures formed in the stem reinforcing portions of the block cage;

said first and second outer pour cover panels are arranged against the first and second outer stem jacket panels, respectively; and said first and second inner pour cover panels are arranged against the first and second inner stem jacket panels, respectively.

3. The machine of claim 2, wherein when said machine is arranged in said closed block molding configuration, said molding surfaces provided by said first and second side panels are arranged to form the top and bottom wall surfaces of the front wall panel of said concrete U-wall construction block during said set of concrete block molding operations;

said molding surfaces provided by said third and fourth side panels are arranged to form the side wall surfaces of the front wall panel of said concrete U-wall construction block during said set of concrete block molding operations;

said molding surfaces provided by said first and second side stem jacket panels are arranged to form the upper and lower surfaces of the stem portions of said concrete U-wall construction during said set of concrete block molding operations;

said molding surfaces of said first and second outer stem jacket panels are arranged to form the outer side surfaces of the stem portions of the concrete U-wall construction block during said set of concrete block molding operations; and said core molding assembly is arranged in said protracted configuration, and said first and second support members are inserted within said central apertures formed in the stem reinforcing portions of the block cage, and said molding surfaces provided by said first and second inner stem jacket panels are arranged to form the inner side surfaces of said stem portions of the concrete U-wall construction block during said set of concrete block molding operations; and wherein, during said set of block molding operations, wet concrete is first poured or injected into said machine to form the front wall panel of the concrete U-wall construction block; and thereafter, without waiting for time to lapse for the poured concrete to cure, said molding surfaces provided by said first and second outer pour cover panels are arranged to form the rear wall surface of the end portions of the front wall panel of the concrete U-wall construction block during said set of concrete block molding operations;

said molding surfaces provided by said first and second inner pour covers are arranged to form the rear wall surface of the central portion of the front wall panel of the concrete U-wall construction block during said set of concrete block molding operations; and said molding surfaces provided by said center pour cover panel are arranged to cover the central region disposed between said first and second inner pour cover panels, and form the rear wall surface of the front wall panel of the concrete U-wall construction block, between said first and second inner pour cover panels, during said set of concrete block molding operations; and then all said pour cover panels are locked, and wet concrete is then poured or injected into a pair of pour openings formed by the configured stem jacket panels, wherein the molding surfaces provided by the configured stem jacket panels form the pair of stem portions of the concrete U-wall construction block being manufactured during said set of concrete block molding operations.

4. The machine of claim 3, wherein when said machine is arranged in said open concrete block unloading configuration, said first and second side panels are arranged and moved away from the top and bottom wall surfaces of the front wall panel of said concrete U-wall construction block formed during said set of concrete block molding operations;

said third and fourth side panels are arranged and moved away from the side wall surfaces of the front wall panel of said concrete U-wall construction block formed during said set of concrete block molding operations;

said first and second side jacket panels are arranged and moved away from the upper and lower surfaces of the stem portions of said concrete U-wall construction block formed during said set of concrete block molding operations;

said first and second outer stem jacket panels are arranged and moved away from the outer side surfaces of the stem portions of the concrete U-wall construction block formed during said set of concrete block molding operations;

said first and second outer pour covers are arranged and moved away from the rear wall surface of the end portions of the front wall panel of the concrete U-wall construction block formed during said set of concrete block molding operations;

said core molding assembly is arranged said protracted configuration, said first and second support members are inserted within the central apertures formed in the stem reinforcing portions of the block cage, about which the concrete U-wall construction block is formed during said set of concrete block molding operations;

said first and second inner pour covers are arranged and moved away from the rear wall surface of the central portion of the front wall panel of the concrete U-wall construction block formed during said set of concrete block molding operations; and said center pour cover panel is moved away from the rear wall surface of the central portion of the front wall panel of the concrete U-wall construction block formed during said set of concrete block molding operations;

whereafter the molded concrete U-wall construction block is unloaded from said machine while arranged in said open concrete block unloading configuration during said set of concrete block unloading operations, using said crane system connected to the support mechanism of said core molding assembly arranged in said protracted configuration; and thereafter, said support mechanism is arranged in said retracted configuration, so as to release said concrete U-wall construction block formed about said block cage during said set of concrete block unloading operations.

5. The machine of claim 1, wherein the machine is capable of molding concrete U-wall construction blocks having different face panel and stem portion thicknesses when said machine is configured with different configuration settings, and wherein said support mechanism in said core molding assembly is adjusted so that the distance between said first and second inside stem jacket panels can be spaced apart in discrete intervals, and then locked into position, to determine the thickness of each stem portion of the concrete U-wall construction block to be molded in said machine during said set of concrete block molding operations.

6. The machine of claim 1, wherein the reinforcing material, from which said block cage is made, is steel.

7. The machine of claim 1, which further comprises a first stem wall screw that passes through said first inner and outer stem jacket panels and the first stem reinforcing portion of the block cage disposed therebetween, for the purpose of aligning the position of said first inner and outer stem jacket panels during said set of concrete block molding operations.

8. The machine of claim 7, which further comprises a second stem wall screw that passes through said second inner and outer stem jacket panels and the second stem reinforcing portion of the block cage disposed therebetween, for the purpose of aligning the position of said second inner and outer stem jacket panels during said set of concrete block molding operations.

9. The machine of claim 1, wherein the thickness of said replaceable front surface forming liner is selected to match the thickness specified for the front wall panel of the concrete U-wall construction block being manufactured, wherein said thickness is determined by the height of said replaceable front surface forming liner installed on top of said support base.

10. The machine of claim 1, said first and second support members comprise first and second cylindrical support drums, respectively.

11. The machine of claim 1, wherein the thickness of the stem portions of the concrete U-wall construction block being manufactured is set by determining the distance maintained between said first and second inner stem jacket panels supported in a parallel manner by said support mechanism during said concrete block molding operations; and wherein said support mechanism is adjusted so that the distance between said first and second inside stem jacket panels is spaced apart at one of several discrete intervals, and then locked into position, to determine the thickness of each stem portion of the concrete U-wall construction block being manufactured during said set of concrete block molding operations.

12. The machine of claim 1, wherein said front wall surface forming liner is made from one or more materials selected from the group consisting of rugged plastic material, metal material, wood material, and other suitable material capable of withstanding the hydrostatic forces generated by the weight of concrete poured into said machine when molding surfaces provided to form the stem portions of said concrete U-wall construction block being manufactured are completely filled with wet poured concrete.

13. The machine of claim 1, wherein said support base further comprises a pair of hollow rectangular pipes allowing said machine to be lifted by a fork-lift machine and placed to a proper location within a factory or plant environment.

14. The machine of claim 1, which further comprises a plurality of front wall surface forming liners, each having a different thickness and adapted for installation upon said support base prior to said set of block cage loading operations.

15. The machine of claim 1, wherein the molding surfaces provided by said first and second side stem jacket panels include a saw-tooth notched pattern for forming a corresponding saw-toothed notched pattern on the upper and lower wall surfaces of the stem portions of said concrete U-wall construction block being manufactured during said set of concrete block molding operations.

16. The machine of claim 15, wherein said saw-tooth notched patterns comprises one of alternating projections formed by projecting planar surfaces, and indents formed by non-projecting planar surfaces with transition sloped surfaces between said indents.

17. The machine of claim 1, wherein said horizontal support surface is the ground surface of a factory or plant.

* * * * *